US009354601B2

(12) United States Patent
Hirasawa et al.

(10) Patent No.: US 9,354,601 B2
(45) Date of Patent: May 31, 2016

(54) LIQUID COOLING DEVICE THAT ARRANGES A COOLANT FLOWING DIRECTION IN ACCORDANCE WITH A TEMPERATURE GRADIENT OF A COOLING AIRFLOW AND IMAGE FORMING APPARATUS INCORPORATING THE SAME

(71) Applicants: Tomoyasu Hirasawa, Kanagawa (JP); Hiromitsu Fujiya, Kanagawa (JP); Keisuke Yuasa, Kanagawa (JP); Yasuaki Toda, Kanagawa (JP); Kenji Ishii, Ibaraki (JP); Susumu Tateyama, Ibaraki (JP); Hiroaki Miyagawa, Ibaraki (JP); Keisuke Ikeda, Kanagawa (JP)

(72) Inventors: Tomoyasu Hirasawa, Kanagawa (JP); Hiromitsu Fujiya, Kanagawa (JP); Keisuke Yuasa, Kanagawa (JP); Yasuaki Toda, Kanagawa (JP); Kenji Ishii, Ibaraki (JP); Susumu Tateyama, Ibaraki (JP); Hiroaki Miyagawa, Ibaraki (JP); Keisuke Ikeda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/477,129

(22) Filed: Sep. 4, 2014

(65) Prior Publication Data

US 2015/0071677 A1 Mar. 12, 2015

(30) Foreign Application Priority Data

Sep. 6, 2013 (JP) ..... 2013-184896
Jul. 3, 2014 (JP) ..... 2014-137617

(51) Int. Cl.
*G03G 21/20* (2006.01)
*F28D 1/02* (2006.01)
*F28D 21/00* (2006.01)

(52) U.S. Cl.
CPC ..... *G03G 21/20* (2013.01); *F28D 1/024* (2013.01); *G03G 21/206* (2013.01); *F28D 2021/0031* (2013.01)

(58) Field of Classification Search
None
See application file for complete search history.

(56) References Cited

U.S. PATENT DOCUMENTS 5,529,116 A * 6/1996 Sasaki ..... F28D 1/0417 123/41.51
2010/0129107 A1* 5/2010 Takehara ..... G03G 21/206 399/92

(Continued)

FOREIGN PATENT DOCUMENTS

JP 2004-239479 * 8/2004
JP 2010-128081 6/2010
JP 2012-098677 5/2012
JP 2012-237940 * 12/2012

OTHER PUBLICATIONS

U.S. Appl. No. 14/151,180, filed Jan. 9, 2014.
U.S. Appl. No. 14/182,734, filed Feb. 18, 2014.
U.S. Appl. No. 14/276,067, filed May 13, 2014.
U.S. Appl. No. 14/248,652, filed Apr. 9, 2014.
U.S. Appl. No. 14/321,908, filed Jul. 2, 2014.

*Primary Examiner* — Clayton E Laballe
*Assistant Examiner* — Jas Sanghera
(74) *Attorney, Agent, or Firm* — Oblon, McClelland, Maier & Neustadt, L.L.P.

(57) ABSTRACT

A liquid type cooling device, which is incorporated in an image forming apparatus, includes a heat receiving part including a heat receiving unit to transport heat from a cooling target to a coolant and a heat releasing part including a heat releasing unit, a cooling fan, and an air flowing space. The heat releasing unit has a coolant flowing path and an air flowing path through which air passes and conducts heat exchange with the coolant. The air flowing space has an air inlet port and an air outlet port. When the air flowing path has an upstream region and a downstream region along a coolant flowing direction of the coolant flowing path, air at high temperature flows into the upstream region of the air flowing path. Alternatively, the heat releasing unit may have a coolant inlet port, a coolant outlet port, and the air flowing path.

18 Claims, 21 Drawing Sheets

(56) References Cited

U.S. PATENT DOCUMENTS

2012/0318473 A1* 12/2012 Nishikawa ..... B60H 1/00328 165/41
2013/0259512 A1 10/2013 Ikeda et al.
2014/0044462 A1 2/2014 Ikeda et al.
2014/0060782 A1 3/2014 Ikeda et al.
2014/0186080 A1 7/2014 Ikeda et al.
2014/0186081 A1 7/2014 Hirasawa et al.

* cited by examiner

LIQUID COOLING DEVICE THAT ARRANGES A COOLANT FLOWING DIRECTION IN ACCORDANCE WITH A TEMPERATURE GRADIENT OF A COOLING AIRFLOW AND IMAGE FORMING APPARATUS INCORPORATING THE SAME

CROSS-REFERENCE TO RELATED APPLICATIONS

This patent application is based on and claims priority pursuant to 35 U.S.C. §119(a) to Japanese Patent Application Nos. 2013-184896, filed on Sep. 6, 2013, and 2014-137617, filed on Jul. 3, 2014 in the Japan Patent Office, the entire disclosures of which are hereby incorporated by reference herein.

BACKGROUND

1. Technical Field

This disclosure relates to a liquid cooling device that cools a cooling target during a printing or copying operation, and an image forming apparatus that includes the liquid cooling device.

2. Related Art

Electrophotographic image forming apparatuses such as printers, facsimile machines, and copiers, typically employ an exposure device, a development device, a fixing device and so forth to process image formation with text, symbol, and the like on a recording medium, for example, a plain sheet and an OHP (overhead projector) sheet. These devices are known to generate heat during respective processes in the image formation.

To form a good image on the recording medium, these devices are adjusted to have a preferable temperature within a given range. To address this inconvenience, the image forming apparatuses include a cooling device to cool a cooling target of any part(s) of these devices when a temperature of the part(s) of the devices increases beyond the given range.

Various types of cooling devices are employed in image forming apparatuses. For example, there are a cooling device to cool a development device, a cooling device to cool a recording medium after an image is fixed by a fixing device, and multiple cooling devices to cool multiple laser diode control substrates of an exposure device. In an image forming apparatus, for example, liquid type cooling devices are employed to respectively cool the development device and the recording medium discharged from the fixing device and air type cooling devices are employed to cool the multiple laser diode control substrates of the exposure device.

SUMMARY

At least one aspect of this disclosure provides a liquid cooling device including a heat receiving part and a heat releasing part. The heat receiving part includes a heat receiving unit to transport heat received from a cooling target to a coolant. The heat releasing part includes a heat releasing unit, a cooling fan, and an air flowing space. The heat releasing unit has a coolant flowing path into which the coolant with the heat transported at the heat receiving part flows and an air flowing path through which air passes and conducts heat exchange with the coolant. The cooling fan generates the flow of air that passes the air flowing path. The air flowing space has an air inlet port in which the air that passes through the air flowing path is taken in and an air outlet port through which the air that has passed through the air flowing path is exhausted. When the air flowing path has an upstream region and a downstream region along a coolant flowing direction of the coolant flowing path of the heat releasing part, air at high temperature flows into the upstream region of the air flowing path.

Further, at least one aspect of this disclosure provides an image forming apparatus including an image forming device that forms an image on a recording medium and the above-described liquid cooling device that cools the recording medium.

Further, at least one aspect of this disclosure provides a liquid cooling device including a heat receiving part and a heat releasing part. The heat receiving part includes a heat receiving unit to transport heat received from a cooling target to a coolant. The heat releasing part includes a heat releasing unit, a cooling fan, and an air flowing space. The heat releasing unit has a coolant inlet port into which the coolant with the heat transported at the heat receiving part flows, a coolant outlet port from which the coolant flows, and an air flowing path through which air passes and conducts heat exchange with the coolant. The cooling fan generates air that passes the air flowing path. The air flowing space has an air inlet port through which the air that passes through the air flowing path is taken in and an air outlet port through which the air that has passed through the air flowing path is exhausted. Air at high temperature flows in the air flowing path in a vicinity of the coolant inlet port according to a temperature distribution that varies across a direction perpendicular to a cooling air flowing direction of air that passes through the air flowing path.

Further, at least one aspect of this disclosure provides an image forming apparatus including an image forming device that forms an image on a recording medium and the above-described liquid cooling device that cools the recording medium.

Further, at least one aspect of this disclosure provides an image forming apparatus including a liquid cooling device, a heat emitting device, and a heated air outlet port. The liquid cooling device includes including a heat receiving part and a heat releasing part. The heat receiving part includes a heat receiving unit to transport heat received from a cooling target to a coolant. The heat releasing part includes a heat releasing unit, a cooling fan, and an air flowing space. The heat releasing unit has a coolant flowing path into which the coolant with the heat transported at the heat receiving part flows and an air flowing path through which air passes and conducts heat exchange with the coolant. The cooling fan generates air that passes the air flowing path. The air flowing space has an air inlet port through which the air that passes through the air flowing path is taken in and an air outlet port through which the air that has passed through the air flowing path is exhausted. The heat emitting device emits heat when fixing an image to a recording medium to be cooled by the liquid cooling device. The heated air outlet port is disposed in the air flowing space at one side in a width direction of the recording medium to exhaust air heated by the heat emitting device to an outside of the image forming apparatus. The heated air outlet port is located at an upstream side of the coolant flowing path in the coolant flowing direction.

BRIEF DESCRIPTION OF THE DRAWINGS

A more complete appreciation of the disclosure and many of the advantages thereof will be obtained as the same becomes better understood by reference to the following detailed description when considered in connection with the accompanying drawings, wherein.

DETAILED DESCRIPTION

Figure 1:
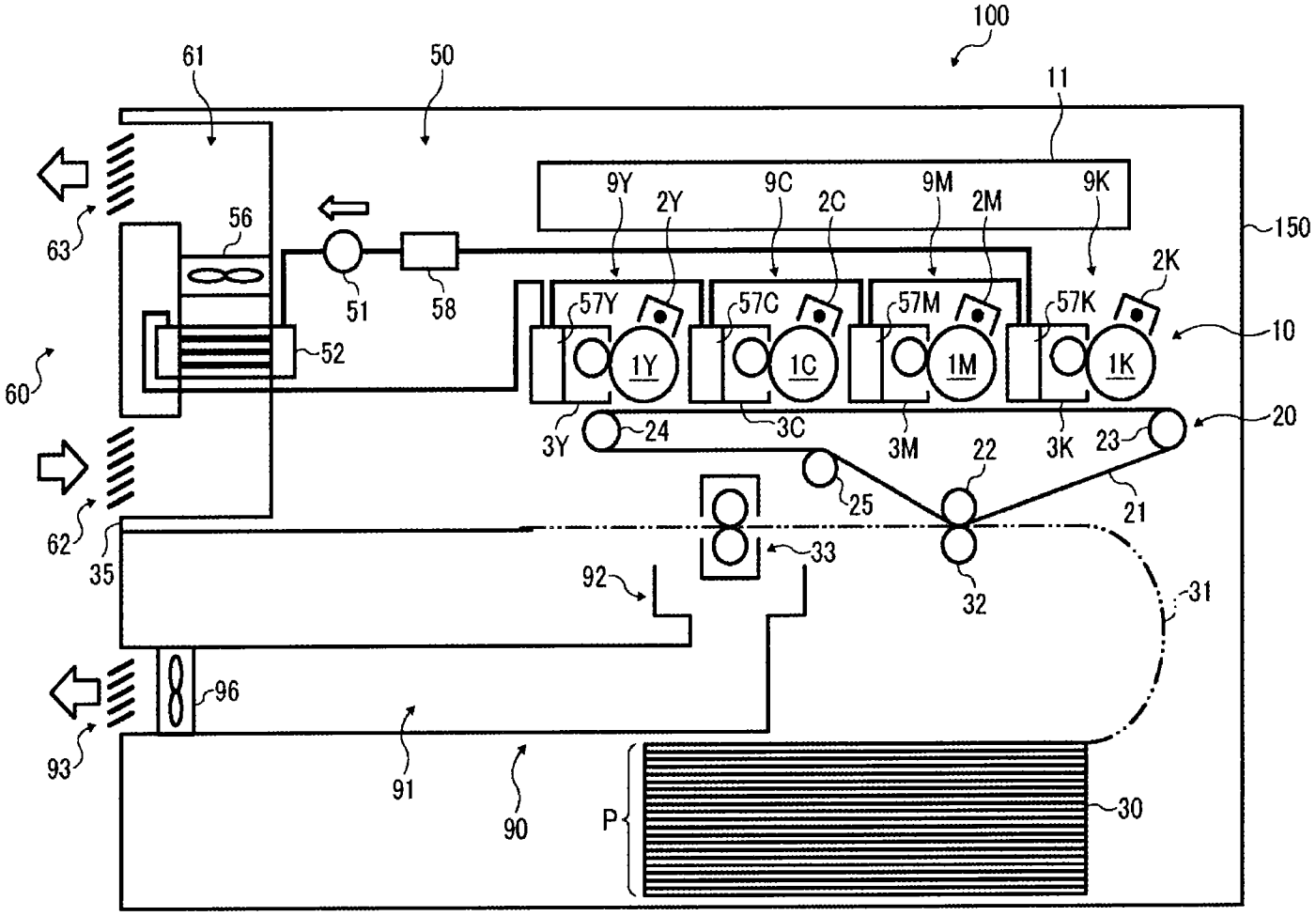
FIG. 1 is a diagram illustrating a schematic configuration of an image forming apparatus according to an example of the disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

A description is given of an electrophotographic image forming apparatus 100 according to an example of the disclosure.

The image forming apparatus 100 may be a copier, a facsimile machine, a printer, a plotter, a multifunction peripheral or a multifunction printer (MFP) having at least one of copying, printing, scanning, facsimile, and plotter functions, or the like. According to the present example, the image forming apparatus 100 is an electrophotographic printer that forms color and monochrome toner images on a sheet or sheets by electrophotography.

More specifically, the image forming apparatus 100 functions as a printer. However, the image forming apparatus 100 can expand its function as a copier by adding a scanner as an option disposed on top of an apparatus body of the image forming apparatus 100. The image forming apparatus 100 can further obtain functions as a facsimile machine by adding an optional facsimile substrate in the apparatus body of the image forming apparatus 100.

Further, it is to be noted in the following examples that the term "sheet" is not limited to indicate a paper material but also includes OHP (overhead projector) transparencies, OHP film sheets, coated sheet, thick paper such as post card, thread, fiber, fabric, leather, metal, plastic, glass, wood, and/or ceramic by attracting developer or ink thereto, and is used as a general term of a recorded medium, recording medium, recording sheet, and recording material to which the developer or ink is attracted.

Now, a description is given of a configuration of the image forming apparatus 100 according to an example of the present embodiment with reference to FIGS. 1 through 6.

In the configuration according to this example of FIGS. 1 through 6, the image forming apparatus 100 includes a fixing part cooling device and a developer cooling device. The fixing part cooling device cools air around a fixing device and maintains the air within a given temperature range. The developer cooling device cools a developer container with developer contained in the development device and maintains the developer within a given temperature range.

Figure 2:
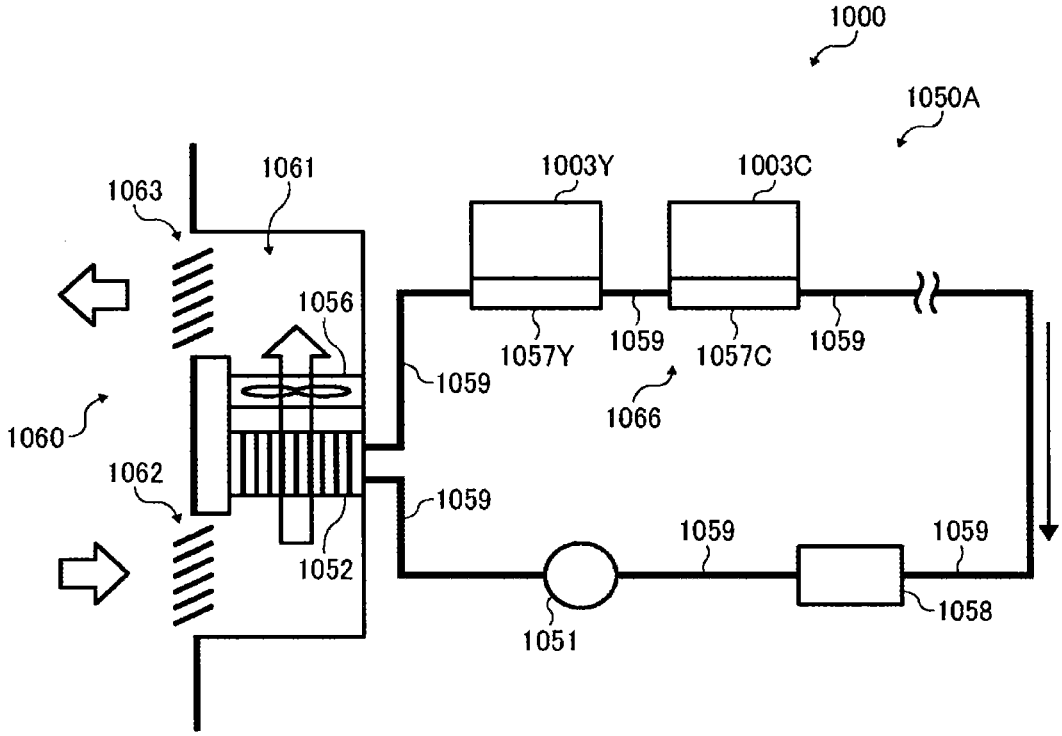
FIG. 2 is a diagram illustrating a comparative configuration of a liquid cooling device as a comparative example.
Figure 3:
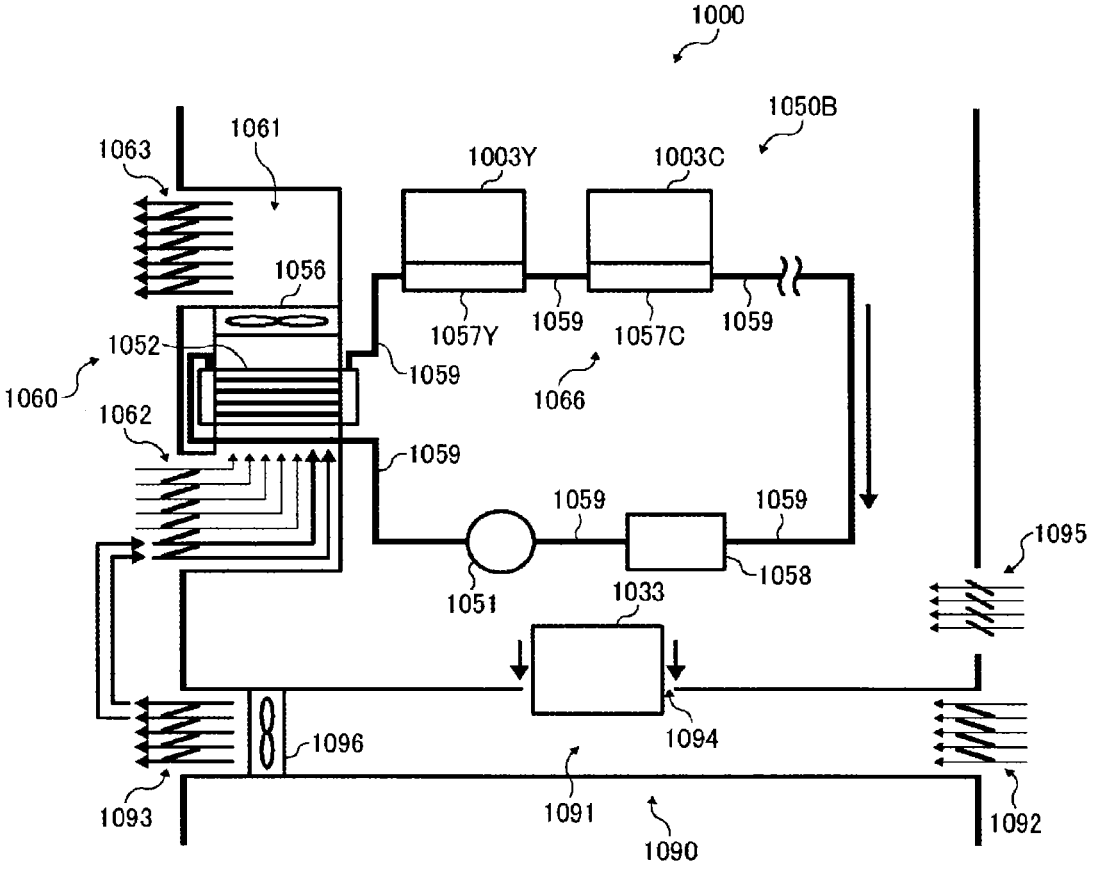
FIG. 3 is a diagram illustrating a detailed configuration of the liquid cooling device of FIG. 2.
Figure 4A:
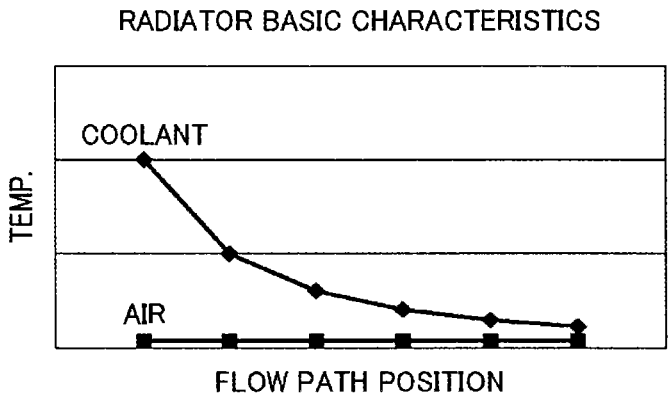
FIGS. 4A through 4C are graphs, each showing the cooling performance of a radiator based on a position of a flowing path of a coolant that flows in coolant conduits of the radiator and temperature distribution of cooling air.
Figure 4B:
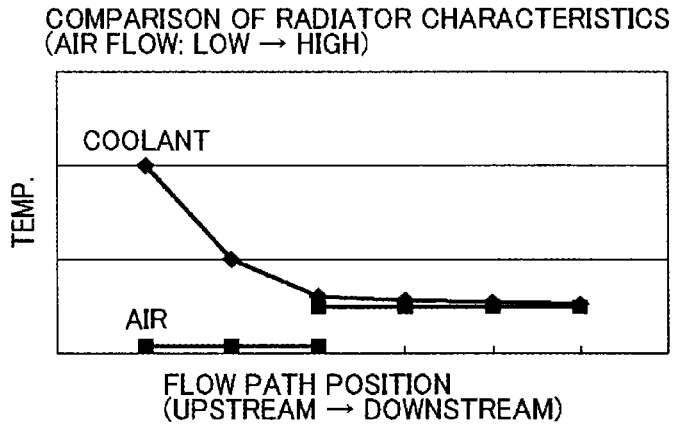
Figure 4C:
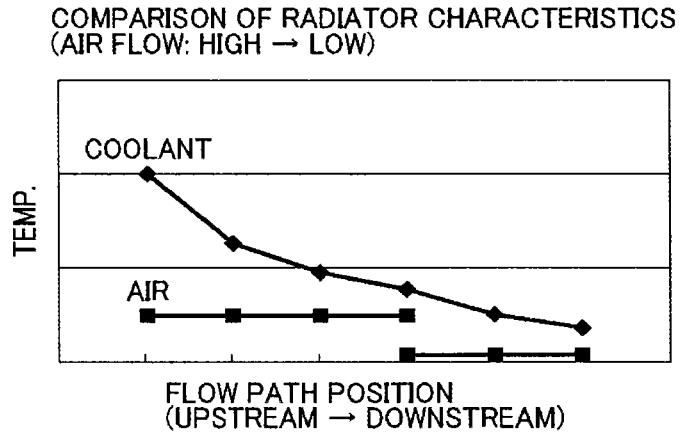
Figure 5:
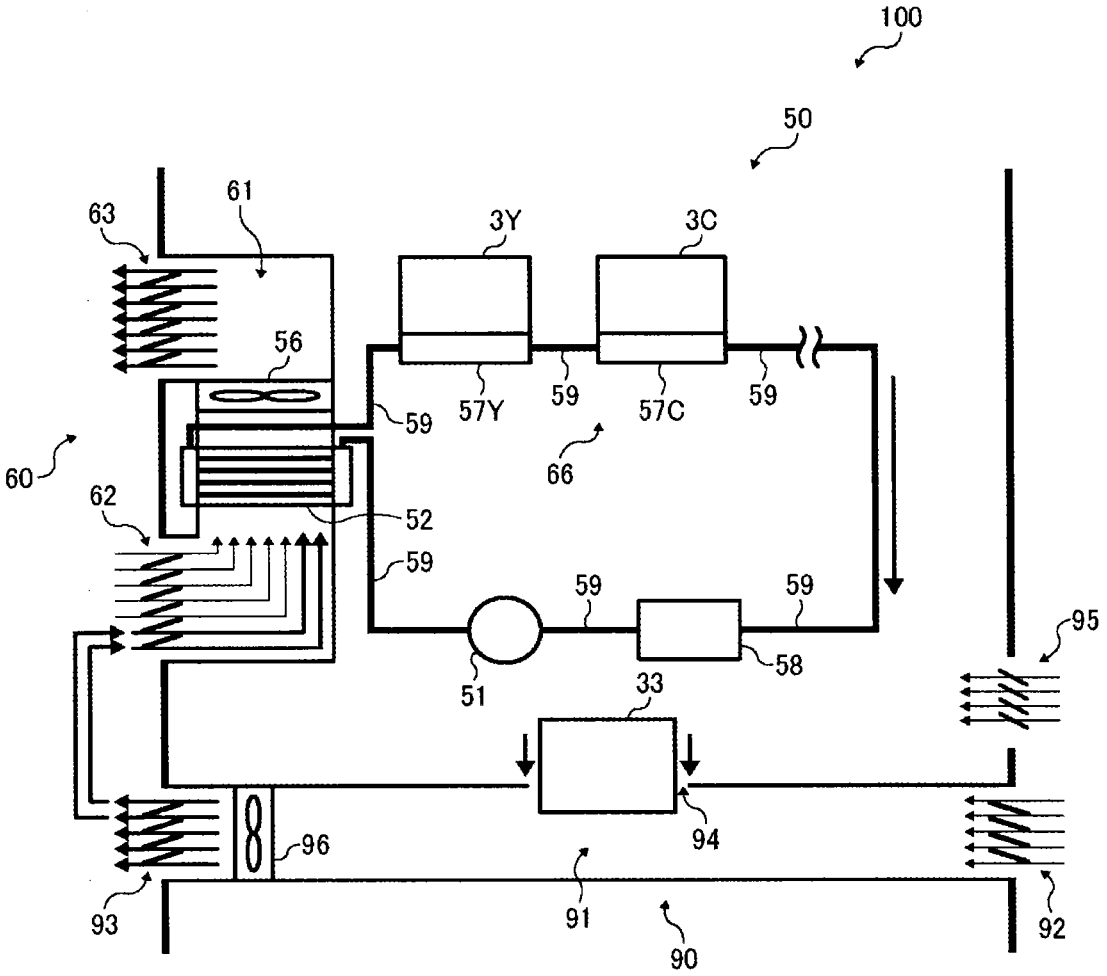
FIG. 5 is a diagram illustrating a schematic configuration of a developer cooling device according to the example of FIG. 1.
Figure 6:
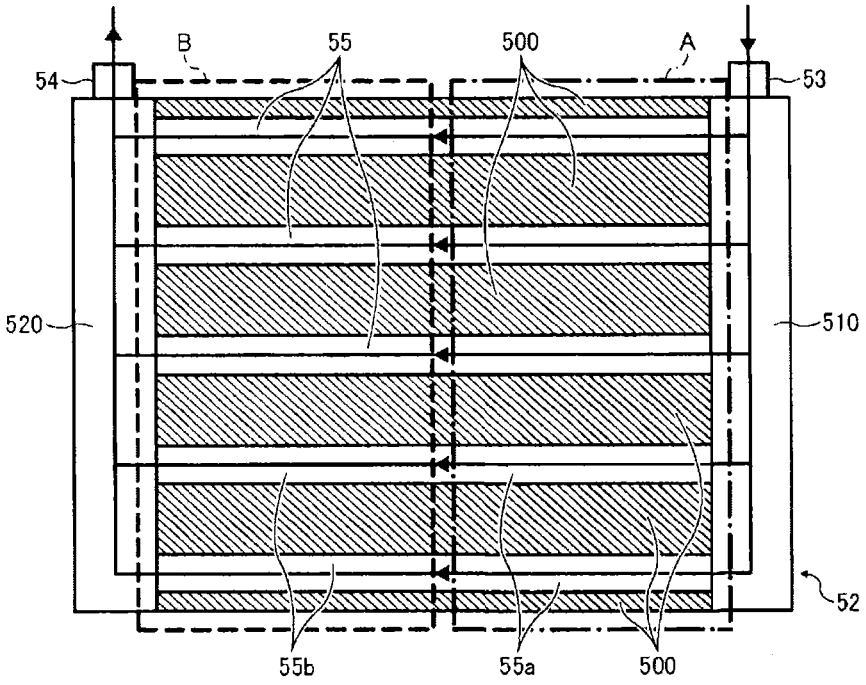
FIG. 6 is a diagram illustrating a schematic configuration of a radiator included in the developer cooling device according to the example of FIG. 1.

FIG. 1 is a diagram illustrating a schematic configuration of the image forming apparatus 100 according to this example of the present embodiment. FIG. 2 is a diagram illustrating a comparative configuration of a cooling device as a comparative example. FIG. 3 is a diagram illustrating a detailed configuration of the comparative cooling device of FIG. 2. FIGS. 4A through 4C are graphs, each showing the cooling performance of a radiator based on a position of a flowing path of a coolant that flows in coolant conduits of the radiator and temperature distribution of cooling air. FIG. 4A is a graph showing a case in which there is no temperature distribution of the cooling air, that is, a case in which the temperature of the cooling air is constant. FIG. 4B is a graph showing a case in which a temperature of the cooling air at an upstream side in a coolant flowing direction is low and a temperature of the cooling air at a downstream side in the coolant flowing direction is high. FIG. 4C is a graph showing a case in which the temperature of the cooling air at the upstream side in the coolant flowing direction is high and the temperature of the cooling air at the downstream side in the coolant flowing direction is low. FIG. 5 is a diagram illustrating a schematic configuration of a developer cooling device 50 according to this example. FIG. 6 is a diagram illustrating a schematic configuration of a radiator 52 included in the developer cooling device 50 according to this example.

The image forming apparatus 100 of this example includes an image forming part 10 having multiple image forming devices 9, and an intermediate transfer part 20 having an intermediate transfer body (i.e., an intermediate transfer belt 21) that transfers respective single color toner images formed in the multiple image forming devices. With this configuration, the image forming apparatus 100 functions as a tandem type image forming apparatus with an intermediate transfer method, in which respective single color toner images formed in the multiple image forming devices 9 aligned on a tensioned surface of the intermediate transfer body (i.e., an intermediate transfer belt 21) in a moving direction of the intermediate transfer body are primarily transferred and overlaid onto the intermediate transfer body sequentially to form a composite toner image, and then the composite toner image is secondarily transferred onto a recording medium (i.e., a sheet P).

A description is given of a basic configuration and functions of the image forming apparatus 100 with reference to FIG. 1.

As illustrated in FIG. 1, the image forming apparatus 100 according to this example includes the image forming part 10. The image forming part 10 includes four image forming devices 9Y, 9C, 9M, and 9K and an optical writing device 11. Suffixes, which are Y, C, M, and K, are used to indicate respective colors of toners (e.g., yellow, cyan, magenta, and black toners) for the process units.

The four image forming devices 9Y, 9C, 9M, and 9K form respective single color toner images of yellow (Y), cyan (C), magenta (M), and black (K) on photoconductors 1Y, 1C, 1M, and 1K, respectively. The optical writing device 11 is disposed above the image forming devices 9Y, 9C, 9M, and 9K and exposes respective surfaces of the photoconductors 1Y, 1C, 1M, and 1K, respectively, to form respective electrostatic latent images thereon.

It is to be noted that FIG. 1 illustrates the four image forming devices 9Y, 9C, 9M, and 9K having the identical configuration and functions to each other except toner colors, which are yellow (Y), magenta (M), cyan (C), and black (K). Each image forming device 9 includes a photoconductor 1 (i.e., photoconductors 1Y, 1C, 1M, and 1K) and an image forming components disposed around the photoconductor 1 in a counterclockwise direction in the drawing. Specifically, the image forming components are a charger 2 (i.e., chargers 2Y, 2C, 2M, and 2K) that is disposed substantially upward from a rotation center of the photoconductor 1, a development device 3 (i.e., development devices 3Y, 3C, 3M, and 3K), an electric discharger, and a photoconductor cleaning device.

Further, primary nip areas are arranged vertically below respective rotation centers of the photoconductors 1Y, 1C, 1M, and 1K in FIG. 1. After the development devices 3Y, 3C, 3M, and 3K develop the respective electrostatic latent images formed on the surfaces of the photoconductors 1Y, 1C, 1M, and 1K, respectively, into respective single color toner images, the color toner images are primarily transferred onto an intermediate transfer belt 21 of an intermediate transfer part 20, details of which are described below. Specifically, the development device 3 is disposed upstream from the corresponding primary transfer nip area in a photoconductor rotation direction and the electric discharger is disposed downstream from the corresponding primary transfer nip area in the photoconductor rotation direction.

As described above, the intermediate transfer part 20 includes the intermediate transfer belt 21. The intermediate transfer part 20 is disposed below the image forming part 10 to primarily transfer the respective single color toner images formed on the photoconductors 1Y, 1C, 1M, and 1K of the four image forming devices 9Y, 9C, 9M, and 9K sequentially onto the intermediate transfer belt 21. The intermediate transfer part 20 includes a drive roller 24, a tension roller 23, and a secondary transfer backup roller 22. The drive roller 24 is disposed on the left side of the intermediate transfer part 20 of FIG. 1. The tension roller 23 is disposed on the right side of the intermediate transfer part 20 of FIG. 1. The secondary transfer backup roller 22 is disposed on the lower side of the intermediate transfer part 20 of FIG. 1. The drive roller 24, the tension roller 23, and the secondary transfer backup roller 22 function as tension rollers and are disposed in contact with an inner circumference of loop of the intermediate transfer belt 21 so as to stretch the intermediate transfer belt 21 outwardly.

Further, the image forming devices 9Y, 9C, 9M, and 9K are disposed in this order from the left side of the image forming part 10 of FIG. 1, facing an outer circumference of a tensioned side of the intermediate transfer belt 21 that is stretched by the drive roller 24 and the tension roller 23.

As described above, the image forming apparatus 100 further includes the primary transfer rollers. Hereinafter, the primary transfer rollers also referred to in a singular form, the primary transfer roller. The primary transfer roller functions as a primary transfer unit to transfer a toner image onto the surface of the intermediate transfer belt 21. The primary transfer rollers are disposed facing the photoconductors 1Y, 1C, 1M, and 1K of the image forming devices 9Y, 9C, 9M, and 9K, respectively, with the intermediate transfer belt 21 interposed therebetween. By using the primary transfer rollers, the primary transfer operation is performed to overlay the respective single color toner images formed on the image forming devices 9Y, 9C, 9M, and 9K, so that a composite color toner images is formed on the intermediate transfer belt 21

A tension roller 25 is disposed in contact with the outer circumference of the intermediate transfer belt 21 to apply a given belt tension force to the intermediate transfer belt 21 by pressing the intermediate transfer belt 21 inwardly.

Further, a belt cleaning device is disposed between the tension roller 25 and the secondary transfer backup roller 22. The belt cleaning device removes residual toner remaining on the intermediate transfer belt 21 after secondary transfer.

A secondary transfer roller 32 is disposed below the intermediate transfer part 20. The secondary transfer roller 32 forms a secondary transfer nip area with the intermediate transfer belt 21 that is pressed by the secondary transfer backup roller 22, so that the composite color toner image formed on the intermediate transfer belt 21 is secondarily transferred onto a sheet P that functions as a recording medium fed from a sheet tray 30.

A registration roller pair is disposed upstream from the secondary transfer roller 32 in a sheet conveying direction. The registration roller pair conveys the sheet P to the secondary transfer nip area in synchronized with movement of the composite color toner image formed on the intermediate transfer belt 21 toward the secondary transfer nip area.

By contrast, a fixing device 33 is disposed downstream from the secondary transfer roller 32 in the sheet conveying direction. The fixing device 33 functions as a heat generator including a heat roller and a pressure roller so as to fix the composite color toner image that is secondarily transferred onto the sheet P by application of heat and pressure.

Further, a sheet discharging port 35 is disposed downstream from the fixing device 33 in the sheet conveying direction. After completion of a fixing operation, the sheet P is discharged from the sheet discharging port 35 to an outside of an apparatus body 150.

Further, the sheet tray 30 is disposed below the secondary transfer roller 32 and the fixing device 33. The sheet tray 30 includes a feed roller and a separation roller and accommodates a stack of multiple sheets including the sheet P. The sheet P is separated from the stack of multiple sheets by the feed roller and the separation roller one by one and is then fed to a sheet conveying path 31.

When image data is sent from an external personal computer or other devices, the image forming apparatus 100 rotates the photoconductor 1 (i.e., the photoconductors 1Y, 1C, 1M, and 1K) of the image forming device 9 (i.e., the image forming devices 9Y, 9C, 9M, and 9K), so that the charger 2 (i.e., the chargers 2Y, 2C, 2M, and 2K) uniformly charges the corresponding surface of the photoconductor 1 (i.e., the photoconductors 1Y, 1C, 1M, and 1K). Thereafter, the optical writing device 11 disposed above the photoconductors 1Y, 1C, 1 M, and 1K emits laser light beams to irradiate the respective surfaces of the photoconductor 1 (i.e., the photoconductors 1Y, 1C, 1M, and 1K), so as to form respective electrostatic latent images based on the image data sent from the external personal computer or other devices. The electrostatic latent images are developed with respective toners by the development device 3 (i.e., the development devices 3Y, 3C, 3M, and 3Y).

The respective single color toner images formed on the surfaces of the photoconductors 1Y, 1C, 1M, and 1K are conveyed to the respective primary transfer rollers facing the photoconductors 1Y, 1C, 1M, and 1K via the intermediate transfer belt 21 along with rotation of the photoconductors 1Y, 1C, 1M, and 1K in a counterclockwise direction in FIG. 1. Due to respective primary transfer biases applied to the primary transfer rollers, the toner images formed on the respective surfaces of the photoconductors 1Y, 1C, 1M, and 1K are primarily transferred and overlaid sequentially onto the surface of the intermediate transfer belt 21, so as to form the composite color toner image on the intermediate transfer belt 21. The composite color toner image that is primarily transferred onto the intermediate transfer belt 21 is conveyed along with endless rotation of the intermediate transfer belt 21 in a clockwise direction, to a secondary transfer nip area where the secondary transfer roller 32 and the secondary transfer backup roller 22 are disposed facing each other with the intermediate transfer belt 21 interposed therebetween.

Further, in synchronization with conveyance of the toner image to the secondary transfer nip area, the sheet P is fed from the sheet tray 30 to the sheet conveying path 31 along with rotations of the feed roller and the separation roller. The sheet P standing by at the registration roller pair is conveyed to the secondary transfer nip area along with rotation of the registration roller pair. Then, the composite color toner image is transferred onto the sheet P that is conveyed to the secondary transfer nip area by the registration roller pair with the aid of a secondary transfer bias that is applied to the secondary transfer roller 32.

The sheet P having the composite color toner image thereon is conveyed along the sheet conveying path 31 to the fixing device 33 disposed downstream from the secondary transfer nip area in the sheet conveying direction. In the fixing device 33, the composite color toner image is fixed to the sheet P. The sheet P after the fixing operation is conveyed toward a sheet discharging roller disposed upstream from and adjacent to the sheet discharging port 35 in the sheet conveying direction, and is discharged along with rotation of the sheet discharging roller.

Residual toner, which remains on the photoconductors 1Y, 1C, 1M, and 1K without being transferred onto the intermediate transfer belt 21 at the primary transfer nip area, is removed by a photoconductor cleaning device that is disposed downstream from the respective primary transfer nip areas in the photoconductors 1Y, 1C, 1M, and 1K in the photoconductor rotation direction. Further, residual toner, which remains on the intermediate transfer belt 21 without being transferred onto the sheet P at the secondary transfer nip area, is also removed by a belt cleaning device. As a result, the image forming part 10 and the intermediate transfer part 20 become ready for a subsequent image forming operation.

Here, an electrophotographic image forming apparatus such as the image forming apparatus 100 according to this example illustrated in FIGS. 1 through 6 are typically used to form a high definition toner image with text(s) and/or symbol(s) on a recording medium such as a paper sheet and an OHP (overhead projector) sheet at high speed.

However, when the electrophotographic image forming apparatus, which has an apparatus body including various image forming devices such as an exposure device, a development device, and a fixing device and an image reading device such as a scanner, performs image scanning and forming operations, the image forming devices generate heat and respective temperatures of the image forming devices increase.

Specifically, in the scanner that scans an original document, a scanner lamp and a scanner motor that drives the scanner lamp generate heat.

In the exposure device, a laser light source and a motor that drives a polygon mirror that rotates at high speed generate heat.

In the development device, a temperature of toner increases due to frictional heat by agitating developer including the toner when a toner charge polarity is applied to the developer and a temperature of a container of the development device that accommodates the developer.

In the fixing device, a temperature therearound increases due to heat generated by a heater that is a heat source to fix the toner image to a recording medium by application of heat and a temperature of a sheet reverse unit that is a sheet conveying path increases due to an increase in the recording medium after the fixing operation.

If the above-described heat stays in the apparatus body, various inconveniences are likely to cause.

For example, the temperature of toner increases to a temperature of or close to its softening temperature, image quality defect occurs and/or moving parts of a photoconductor unit, a development device, a toner container and so forth are locked to result in malfunction. Further, the increase in temperature of toner deteriorates oil for bearings and shortens mechanical life of a motor that functions as a power source to rotate each rotary body. Alternatively, if IC heat radiation on an electric substrate provided to each controller becomes small, a malfunction and a failure can occur. Further, resin products having a relatively low heatproof temperature can be deformed.

Further, when the recording media after the fixing operation are discharged to a sheet discharging tray and are stacked in layers, the accumulated stack of recording media can keep heat in the stack so as to soften the toner. Thus, with the toner adhered to a toner image formed on the recording medium, if different recording media are further accumulated in the sheet discharging tray, a pressure is caused by the force of gravity of the stack of recording media. This pressure can cause adjacent recording media of the stack in the sheet discharging tray to stick to each other, which is called as toner blocking. In this case, if the recording media are detached forcibly from each other, the toner image formed on both or either one of the adjacent recording media can be damaged or broken.

Recent image forming apparatuses available for higher speed image forming operations increase respective amounts of heat generation of process units/devices. At the same time, the size of an image forming apparatus has decreased, and therefore the process units/devices are provided close to each other in the apparatus body. Consequently, an increasing number of image forming apparatuses have process units/devices that require temperature control and a cooling device to cool the recording medium/media.

Further, it has been difficult for a conventional cooling fan with an air cooling method to sufficiently cool the process units/devices and the recording medium/media. Therefore, it is known that some image forming apparatuses employ cooling devices and components with a liquid cooling method as a more efficient cooling method.

It is also known that some image forming apparatuses employ different cooling devices including at least a liquid cooling device so as to cool multiple cooling targets. The "liquid cooling device" refers to a cooling device that includes coolant flowing path(s) on each of the cooling targets or on a heat receiving unit to closely or approximately contact the cooling targets directly or via a different member, so as to take heat from the cooling targets by flowing (supplying) coolant that has a lower temperature than a temperature of the cooling targets in the coolant flowing path(s).

Now, a description is given of a comparative configuration of a cooling device as a comparative example.

For example, cooling members and units included in a comparative developer cooling device 1050A illustrated in FIG. 2 are basically the same as the developer cooling device 50 of the image forming apparatus 100 according to the present example illustrated in FIG. 1. However, in the developer cooling device 1050A of FIG. 2, the configuration of the radiator 1052 has not been considered with respect to cooling air that passes between cooling tubes and cooling fins of the radiator 1052 and coolant that passes in multiple coolant conduits of the radiator 1052 (hereinafter, simply referred to as "coolant").

Specifically, the comparative developer cooling device 1050A includes a liquid cooling duct 1061 that functions as an air flowing space having an interior space in which the radiator 1052 and a cooling fan 1056 are placed therein. The liquid cooling duct 1061 includes an air intake port 1062 and an air exhaust port 1063.

The developer cooling device 1050A further includes rubber tubes 1059. The rubber tubes 1059 are tubular members that function as outer coolant conduits to let the liquid coolant flow between an outlet of an upstream unit and an inlet of a downstream unit arranged in a coolant conveying direction, and that function as circulating paths to circulate the coolant by serially connecting a coolant feed pump 1051, the radiator 1052, cooling jackets 1057Y, 1057C, 1057M, and 1057K, and the reserve tank 1058 of the developer cooling device 1050A.

As described above, recent image forming apparatuses increase respective amounts of heat generation of process units/devices, and at the same time, the size of the image forming apparatus has reduced, and therefore the process units/devices are provided close to each other in the apparatus body. Accordingly, it is likely that a cooling air exhaust port of a cooling device that cools a different cooling target is disposed in the vicinity of an air intake port of a liquid cooling device.

For example, an image forming apparatus 1000 illustrated in FIG. 3 includes a fixing part cooling device 1090 that is an air cooling type device in addition to a developer cooling device 1050B that is a liquid cooling type device. The fixing part cooling device 1090 cools air around a fixing device 1033 that functions as a heat emitting device.

An air exhaust port 1093 is included in the fixing air cooling device 1090 and is disposed in the vicinity of an air intake port 1062 of the developer cooling device 1050B. The air exhaust port 1093 is an air exhaust part that functions as an outlet port to exhaust a heated air from the fixing part cooling device 1090.

A cooling air intake port 1092 is provided at one end of an air cooling duct 1091 to connect the air vent formed on the outer surface of the image forming apparatus 1000. The air exhaust port 1093 is provided at an opposite end of the air cooling duct 1091 and opposite to the cooling air intake port 1092, to connect the air vent. Further, an air cooling discharging fan 1096 is provided in the vicinity of an interior part of the air exhaust port 1093 to discharge the air in the air cooling duct 1091 from the air exhaust port 1093.

As the air cooling discharging fan 1096 is driven, outside air that is taken from an air intake port 1095 that is formed on the outer surface of the image forming apparatus 1000 via gaps formed between the fixing device 1033 and a fixing device receiving opening 1094 and outside air that is taken from the cooling air intake port 1092 of the air cooling duct 1091 are discharged from the air exhaust port 1093.

It is to be noted that arrows illustrated in FIG. 3 indicate flows of the cooling air of the developer cooling device 1050B and the fixing part cooling device 1090 and flows of air that has passed areas around the radiator 1052 and the fixing device 1033. Thin arrows indicate flows of air at relatively low temperature and thick arrows indicate flows of air at relatively high temperature.

As described above, when the air exhaust port 1093 of the fixing part cooling device 1090 is disposed in the vicinity of the air intake port 1062 of the developer cooling device 1050B, air having a temperature raised by cooling the fixing device 1033 is exhausted from the air exhaust port 1093 of the fixing part cooling device 1090 and part of the air having the raised temperature is taken from the air intake port 1062 of the developer cooling device 1050B. Consequently, the cooling air that passes in paths (hereinafter, air flowing paths) between the cooling tubes and the cooling fins of the radiator 1052 can have a temperature distribution that is perpendicular to the flows of the cooling air.

Specifically, there are some regions (or areas) in the air flowing paths of the radiator where the cooling air is at relatively low temperature and relatively high temperature. In one region in the air flowing paths of the radiator 1052 flows the cooling air that is exhausted from the air exhaust port 1093 of the fixing part cooling device 1090 and that the temperature thereof increases. In another region in the air flowing paths of the radiator 1052 flows the cooling air that is taken from the outside of the image forming apparatus 1000 and that the temperature thereof is relatively low.

Further, due to heat exchange performed between the cooling air and a coolant that flows in the cooling tubes in the radiator 1052 (hereinafter, the coolant), the coolant is cooled and the temperature thereof falls as the coolant flows from an upstream side to a downstream side in a coolant flowing direction.

Further, as the radiator 1052 is a typical liquid cooling type radiator, the radiator cannot reduce the temperature of the coolant lower than the temperature of the cooling air.

Due to the above-described reasons, the developer cooling device 1050B of FIG. 3 is different from the developer cooling device 1050A of FIG. 2 having the configuration in which the cooling air taken from the outside of the image forming apparatus 1000 has the low temperature air and therefore the cooling air does not have the temperature distribution. The developer cooling device 1050B of FIG. 3 having the temperature distribution has the features as described below.

In the region where the cooling air at high temperature flows in the air flowing paths of the radiator 1052, as a difference between the temperature of the air flowing paths and the temperature of the cooling air at high temperature becomes smaller, the heat exchange works less than the region in which the cooling air at low temperature flows in the air flowing paths. And, the temperature of the coolant in the vicinity of the coolant outlet port of the radiator that is disposed on a downstream side in the coolant flowing direction, which is the temperature of the coolant that flows out from the coolant outlet port of the radiator 1052, becomes higher than the temperature of the configuration that does not include the temperature distribution of the above-described cooling air.

As described above, as the temperature of the coolant that flows from the radiator increases, the heat exchange in cooling jackets 1057Y, 1057C, 1057M, and 1057K functioning as heat receiving units disposed in closely contact with development devices 1003Y, 1003C, 1003M, and 1003K in a heat receiving area 1066 to absorb heat of developer including toner that is a coolant target decreases. The heat receiving area 1066 functions as a heat receiving part. As a result, cooling performance of the developer cooling device 1050B that cools the developer including the toner decreases.

In order to compensate the decrease in cooling performance of the developer cooling device 1050B, it may need to raise the rotation speeds of a coolant feed pump 1051 that conveys the coolant and the cooling fan 1056 and/or to increase the size of the radiator 1052 at production design.

Accordingly, compared with the developer cooling device 1050A of FIG. 2 having the temperature distribution of the cooling air, the developer cooling device 1050B of FIG. 3 having the temperature distribution of the cooling air has a decreased cooling efficiency of the developer cooling device 1050B.

As a result of numerous studies of solving the above-described inconvenience, an efficient cooling method was found to perform an efficient cooling operation even when an air intake port that intakes air that passes in a heat releasing part 1060 is disposed in the vicinity of a cooling air exhaust port of a different cooling device.

Next, a description is given of reasons of the above-described inconveniences and outline of the suggested solutions, with reference to FIGS. 4A through 4C.

Lines connecting diamond icons plotted in FIGS. 4A, 4B, and 4C indicate a change in temperatures according to each location of the coolant in coolant flowing paths (i.e., cooling tubes) of a radiator (e.g., the radiator 52) and lines connecting square icons plotted in FIGS. 4A, 4B, and 4C indicate a change in temperatures according to each location of the cooling air in the coolant flowing paths (i.e., the cooling tubes) of the radiator.

When the cooling air does not have the temperature distribution, that is, when the cooling air is constant in the coolant flowing paths of the radiator, the temperature of the coolant lowers as the coolant flows from an upstream side (i.e., in the vicinity of the coolant inlet port) to a downstream side (i.e., in the vicinity of the coolant outlet port), as illustrated in FIG. 4A.

By contrast, when cooling air has the temperature distribution, the temperature distribution of the cooling air is reversed at the upstream side and the downstream side, as illustrated in FIGS. 4B and 4C.

For example, as illustrated in FIG. 4A, as the difference between the temperature of the cooling air and the temperature of the coolant becomes smaller, a rate of decrease in temperature of the coolant (a heat exchange rate) between the positions of the coolant flowing paths exponentially decreases.

In FIG. 4B, the temperature of the cooling air at the upstream side in the coolant flowing direction is relatively low and the temperature of the cooling air at the downstream side in the coolant flowing direction is relatively high. By contrast, in FIG. 4C, the temperature of the cooling air at the upstream side in the coolant flowing direction is relatively high and the temperature of the cooling air at the downstream side in the coolant flowing direction is relatively low.

In a case of the graph of FIG. 4B, in a region before the temperature of the cooling air at the upstream side in the coolant flowing direction changes, the difference of the temperature of the cooling air that passes the air flowing paths of the radiator and the temperature of the coolant that passes in the cooling tubes of the radiator can be the same as the difference of the temperature of the cooling air and the temperature of the coolant in the graph of FIG. 4A in which the cooling air does not have the temperature distribution. Therefore, similar to the temperature of the coolant in the graph of FIG. 4A, the temperature of the coolant in the graph of FIG. 4B decreases efficiently.

However, in a region after the temperature of the cooling air at the downstream side in the coolant flowing direction has changed, the temperature of the cooling air that passes in the air flowing paths of the radiator is relatively high. Therefore, the difference of the temperature of the cooling air that passes the air flowing paths of the radiator and the temperature of the coolant that passes in the cooling tubes of the radiator may be smaller than the difference of the temperature of the cooling air and the temperature of the coolant in the graph of FIG. 4A in which the cooling air does not have the temperature distribution. As a result, it becomes difficult to lower the temperature of the coolant.

Further, as illustrated in the graph of FIG. 4B, in a case in which the temperature of the coolant when changing from the low temperature to the high temperature of the cooling air is higher than the cooling air at high temperature, the temperature of the coolant cannot be decreased to be lower than the cooling air at high temperature.

Further, when the cooling air at high temperature that passes the air flowing paths of the radiator (e.g., the radiator 52) is narrow and the temperature of the coolant becomes lower than the cooling air at high temperature flows at a time when the temperature of the cooling air changes to the high temperature, a direction of heat exchange of the cooling air and the coolant is reversed. If the direction of heat exchange of the cooling air and the coolant is reversed, the temperature of the coolant that has been cooled to the temperature lower than the cooling air at high temperature is heated by the cooling air at high temperature, so as to increase to the temperature of the coolant.

By contrast, as illustrated in the graph of FIG. 4C, the cooling air at high temperature flows in the upstream side in the coolant flowing direction. Therefore, when compared with the graphs of FIGS. 4A and 4B, the difference of the temperature of the cooling air that passes the air flowing paths of the radiator and the temperature of the coolant that passes the coolant flowing paths becomes small and, at the same time, the heat exchange rate or the rate of decrease in temperature of the coolant can be maintained in a preferable range.

Consequently, the cooling air at low temperature passes at the downstream side in the coolant flowing direction, and therefore the temperature of the cooling air that passes the air flowing paths of the radiator in the graph of FIG. 4C becomes the same as the temperature of the cooling air in the graph of FIG. 4A having no temperature distribution of the cooling air. Therefore, the difference of temperatures of the cooling air and the coolant of FIG. 4C when the temperature of the cooling air changes or after the temperature of the cooling air has changed can be greater than the difference of temperatures of the cooling air and the coolant of FIG. 4A having no temperature distribution of the cooling air and the difference of temperatures of the cooling air and the coolant of FIG. 4B. As a result, the temperature of the coolant of FIG. 4C can be lower than the temperature of the coolant of FIG. 4B.

Due to the above-described reasons, the temperature of the coolant that flows out of the coolant outlet port is reduced more when the coolant flows in the configuration in which the cooling air at high temperature having the temperature distribution flows in the vicinity of the coolant inlet port in the air flow paths of the radiator than when the coolant flows in the configuration in which the cooling air at low temperature having the temperature distribution flows in the vicinity of the coolant inlet port in the air flow paths of the radiator.

It is to be noted that the temperature of the cooling air with reference to the graphs of FIGS. 4A through 4C changes in a cascade shape. However, the same effect can be obtained by using a configuration, for example, in which the temperature of the cooling air changes, for example, in one direction in a linear shape with respect to the coolant flowing direction.

Further, compared with the configuration in which the low temperature cooling air having the temperature distribution flows in the vicinity of the coolant inlet port of the air flowing paths of the radiator, this configuration can prevent the raise of the rotation speeds of a coolant feed pump (e.g., the coolant feed pump 51) that conveys the coolant and a cooling fan (e.g., the cooling fan 56) and/or an increase in size of the radiator (e.g., the radiator 52) at production design.

Therefore, even if an air exhaust port (e.g., the air exhaust port 93) of a fixing part cooling device (e.g., the fixing part cooling device 90) is disposed in the vicinity of an air intake port (e.g., the air intake port 62) through which the air is taken in to pass in the air flowing paths of the radiator, this configuration can prevent the decrease in cooling efficiency of a developer cooling device (e.g., the developer cooling device 50) more than the configuration in which the cooling air at low temperature flows in the vicinity of the coolant inlet port of the air flowing paths.

Accordingly, the developer cooling device 50 according to the example illustrated in FIG. 1 is a liquid type cooling device used in the image forming apparatus 100 having multiple cooling devices and includes an air exhaust port 93 (refer to FIG. 5) of a fixing part cooling device 90 that cools air around the fixing device 33 that functions as a heat emitting device. The air exhaust port 93 functions as an outlet port to exhaust a heated air from the fixing part cooling device 90. The air exhaust port 93 is disposed close to the air intake port 62 that intakes air that passes in the radiator 52. Even in this configuration, the developer cooling device 50 can restrain a decrease in cooling performance of the developer cooling device 50.

Further, unless otherwise specified, the image forming apparatus 100 according to the following examples and a comparative cooling device described below share identical terms of units and components having common functions.

Next, a detailed description is given of a liquid type developer cooling device 50 included in the image forming apparatus 100 according to the example illustrated in FIGS. 5 and 6.

As illustrated in FIG. 1, the image forming apparatus 100 according to this example includes the cooling jackets 57Y, 57C, 57M, and 57K functioning as heat receiving units of the developer cooling device 50. The cooling jacket 57 (i.e., the cooling jackets 57Y, 57C, 57M, and 57K) is disposed in a heat receiving area 66 in contact with one side of the development device 3 (i.e., the development devices 3Y, 3C, 3M, and 3K) of the image forming device 9 (i.e., the image forming devices 9Y, 9C, 9M. and 9K). The heat receiving area 66 functions as a heat receiving part.

Further, as illustrated in FIGS. 1 and 5, the image forming apparatus 100 also includes a radiator 52, a cooling fan 56, and a liquid cooling duct 61.

The radiator 52 is disposed on the left side of the cooling jacket 57 in FIG. 1. The radiator 52 functions as a heat releasing unit of a heat releasing part 60.

The cooling fan 56 is arranged close to the radiator 52 to blow outside air to the radiator 52 so as to increase the cooling performance of the developer cooling device 50.

The liquid cooling duct 61 functions as an air flowing space having an interior space in which the radiator 52 and the cooling fan 56 are placed therein. The liquid cooling duct 61 includes the air intake port 62 and an air exhaust port 63.

As illustrated in FIGS. 1 and 5, the developer cooling device 50 includes rubber tubes 59. The rubber tubes 59 are tubular members that function as outer coolant conduits to let the liquid coolant flow between an outlet of an upstream unit and an inlet of a downstream unit arranged in a coolant conveying direction, and that function as circulating paths to circulate the coolant by serially connecting the coolant feed pump 51, the radiator 52, the cooling jackets 57Y, 57C, 57M, and 57K, and the reserve tank 58 of the developer cooling device 50.

The cooling jackets 57Y, 57C, 57M, and 57K are made of aluminum. The radiator 52 uses aluminum corrugated fins. The coolant contains water and is used by adding propylene glycol and ethylene glycol in order to reduce a freezing temperature of the coolant.

It is to be noticed that the developer cooling device 50 according to the present example includes the reserve tank 58. However, the configuration of the developer cooling device 50 is not limited thereto. For example, a configuration of the developer cooling device 50 without the reserve tank 58 can be applied.

In the developer cooling device 50 according to the example of FIGS. 5 and 6, the coolant travels through the rubber tubes 59 connected to the cooling devices and components therein. Specifically, the coolant in the developer cooling device 50 is fed from the coolant feed pump 51, passes the radiator 52, the cooling jackets 57Y, 57C, 57M, and 57K, and the reserve tank 58, and returns to the coolant feed pump 51. The coolant that is heated by receiving heat from the cooling jackets 57Y, 57C, 57M, and 57K functioning as heat receiving units is cooled in the radiator 52. Therefore, by circulating a given amount of coolant between the cooling devices and components in the developer cooling device 50, the toner that is a cooling target can be cooled.

As described above, the cooling jacket 57 is disposed in close contact with one side of the developer container of the development device 3 via a thermal conductive sheet with low hardness. Since a casing that forms the developer container of the development device 3 is aluminum having high thermal conductivity, the whole casing can cool the developer including the toner by cooling the side of the casing.

The coolant that has received heat of the toner (the developer) from the side of the developer container of the development device 3 at the cooling jacket 57 is cooled by heat exchange with cooling air in the air flowing path of the radiator.

The radiator 52 is disposed in the liquid cooling duct 61 including the air intake port 62 and the air exhaust port 63. The liquid cooling duct 61 is connected to an air vent that is formed on an outer surface of the apparatus body 150 of the image forming apparatus 100. By driving the cooling fan 56 in the liquid cooling duct 61, air that flows from the outside of the image forming apparatus 100 is drawn into the liquid cooling duct 61 to be a cooling air. When passing in the air flowing path of the radiator 52, the heat is exchanged between the coolant and the cooling air in the radiator 52. The air that has passed the radiator 52 is exhausted to the outside of the image forming apparatus 100 through the air exhaust port 63.

As described above, when the cooling fan 56 is driven, the cooling air that is developed by taking air that flows from the outside of the image forming apparatus 100 via the air intake port 62 generates forced heat convection transfer between the cooling air and the cooling tubes and the cooling fins, both of which are the coolant flowing paths of the radiator 52. By so doing, the temperature of the coolant that flows in the coolant conduit of the radiator 52 decreases.

As illustrated in FIG. 5, in addition to the developer cooling device 50 to cool the toner as a cooling target along the side of the developer container of the development device 3, the image forming apparatus 100 according to the present example includes the fixing part cooling device 90 to cool the fixing device 33 by passing air that flows around the fixing device 33.

The toner of each single color is a cooling target of the developer cooling device 50 and is included in the developer contained in the respective developer container of the development device 3. Each toner is cooled with the above-described liquid cooling method.

By contrast, the air that flows around the fixing device 33, which is a cooling target of the fixing part cooling device 90, is cooled with a known air cooling method.

Specifically, the fixing part cooling device 90 cools the air around the fixing device 33 by exhausting the air from the air cooling discharging fan 96 to the outside of the image forming apparatus 100 as follows.

The fixing part cooling device 90 includes an air cooling duct 91. The air cooling duct 91 has a fixing device receiving opening 94 on top thereof. The fixing device receiving opening 94 is greater than a shape of a lower part of the fixing device 33, so that the lower part of the fixing device 33 is inserted into the air cooling duct 91 through the fixing device receiving opening 94.

A cooling air intake port 92 is provided at one end of the air cooling duct 91, which is The right side part of FIG. 5, to connect the air vent formed on the outer surface of the Apparatus body 150of the image forming apparatus 100. The air exhaust port 93 is provided At an opposite end of the air cooling duct 91, which is the left side part of FIG. 5 and opposite To the cooling air intake port 92, to connect the air vent. Further, an air cooling discharging Fan 96 is provided in the vicinity of an interior part of the air exhaust port 93 to discharge the Air in the air cooling duct 91 from the air exhaust port 93.

As the air cooling discharging fan 96 is driven, outside air that is taken from an air intake port 95 that is formed on the outer surface of the apparatus body 150 of the image forming apparatus 100 via gaps formed between the fixing device 33 and the fixing device receiving opening 94 and outside air that is taken from the cooling air intake port 92 of the air cooling duct 91 are discharged from the air exhaust port 93.

When the outside air taken from the intake port 95 is drawn from the gaps between the fixing device 33 and the fixing device receiving opening 94, the outside air moves along side surfaces of an upper part and a top surface of the fixing device 33, so that the side surfaces of the upper part and the top surface of the fixing device 33 are cooled and, at the same time, air around the upper part of the fixing device 33 is cooled.

Further, when passing the lower part of the fixing device 33, the outside air taken from the cooling air intake port 92 of the air cooling duct 91 is drawn along the side surfaces of the lower part and the bottom surface of the fixing device 33. By so doing, the side surfaces of the lower part and the bottom surface of the fixing device 33 are cooled, while at the same time the air around the lower part of the fixing device 33 is cooled.

Accordingly, the air around the fixing device 33 is cooled by driving the air cooling discharging fan 96 with the above-described known air cooling method.

Consequently, the temperature of the air that is discharged from the air exhaust port 93 by driving the air cooling discharging fan 96 of the fixing part cooling device 90 is increased. When discharged from the air exhaust port 93, part of the air of raised temperature is taken in from the air intake port 62 of the liquid cooling duct 61 of the developer cooling device 50 since the air intake port 62 is disposed in the vicinity of the air exhaust port 93. As a result, the cooling air that passes from the air flowing path of the radiator 52 of the developer cooling device 50 has temperature distribution depending on the position of the air flowing path of the radiator 52 (e.g., a temperature distribution that is perpendicular to a cooling air flowing direction).

Specifically, the liquid cooling duct 61 as illustrated in FIG. 5 is arranged so that a temperature of the cooling air that passes air flowing paths 500 of the radiator 52 is higher in a region A than in a region B. Then, in the radiator 52 as illustrated in FIG. 6, the coolant flows in (is supplied) from a coolant inlet port 53 that functions as a coolant inlet port of the coolant close to the region A and is divided in a coolant divider 510 to travel along arrows in the drawing in multiple coolant conduits 55 aligned in parallel to each other. The coolant divider 510 is connected to the coolant inlet port 53 and the multiple coolant conduits 55. The multiple coolant conduits 55 includes first coolant conduits 55*a* and second coolant conduits 55*b* to function as coolant flowing paths of the coolant in the radiator 52. After flowing in the region B, the coolant is merged in a coolant merger 520 and flows out (is discharged) from a coolant outlet port 54 that functions as a coolant outlet port of the coolant from the radiator 52. The coolant merger 520 is connected to the multiple coolant conduits 55 and the coolant outlet port 54.

That is, the air passes in the air flowing paths 500 including each of the cooling fins provided between adjacent cooling conduits and each of openings between the cooling fins. The radiator 52 has a configuration in which the coolant flows in the multiple coolant conduits 55 of the radiator 52 such that the temperature of the air that flows in each of the air flowing paths 500 is higher in the region A than in the region B.

Accordingly, by including the above-described radiator 52, the coolant moves from the region A where the temperature of the cooling air that passes in the air flowing paths of the radiator 52 is high to the region B where the temperature of the cooling air is low. Therefore, the difference of temperature of the cooling air that exchanges heat with the coolant can be most increased. Therefore, even if the cooling air that passes through the air flowing paths of the radiator 52 has temperature distribution, the temperature of the coolant can be decreased most efficiently.

Further, by including the developer cooling device 50, the image forming apparatus 100 according to the example illustrated in FIGS. 1 through 6 can achieve the same effects as the above-described effects provided by the developer cooling device 50.

Figure 7:
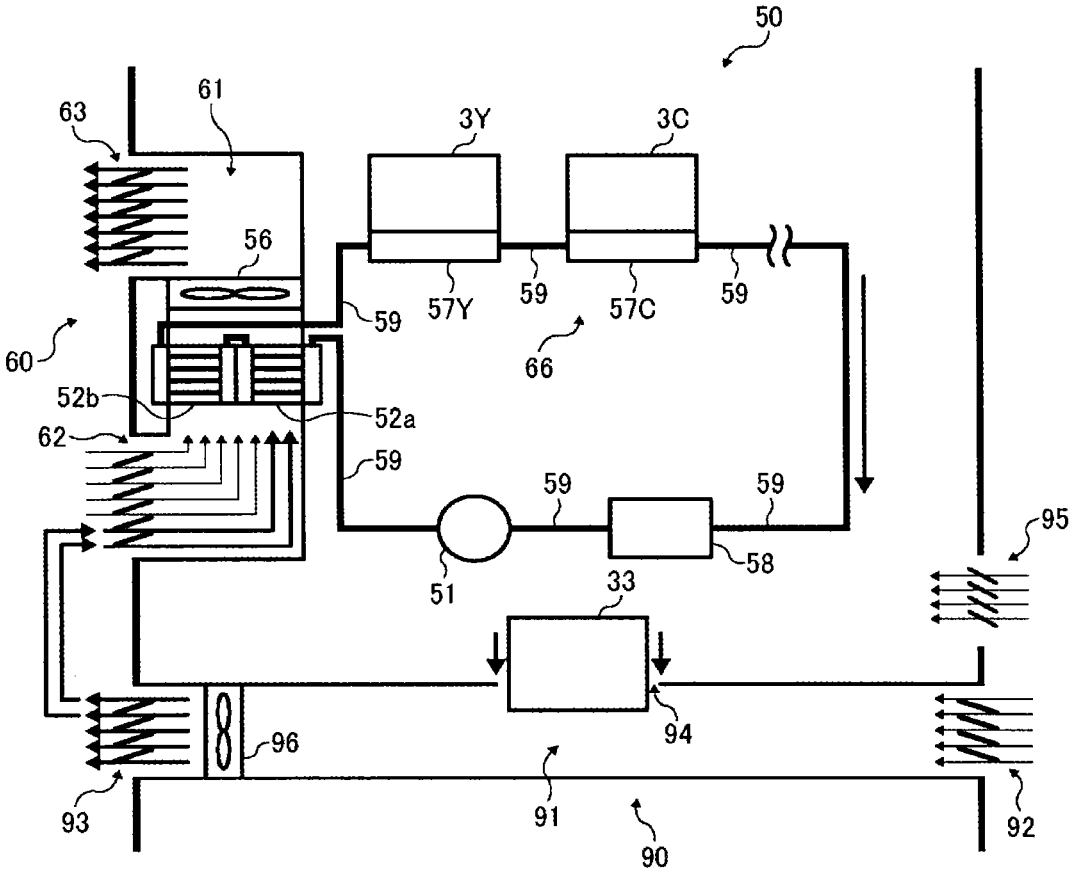
FIG. 7 is a diagram illustrating a schematic configuration of a developer cooling device according to another example.
Figure 8:
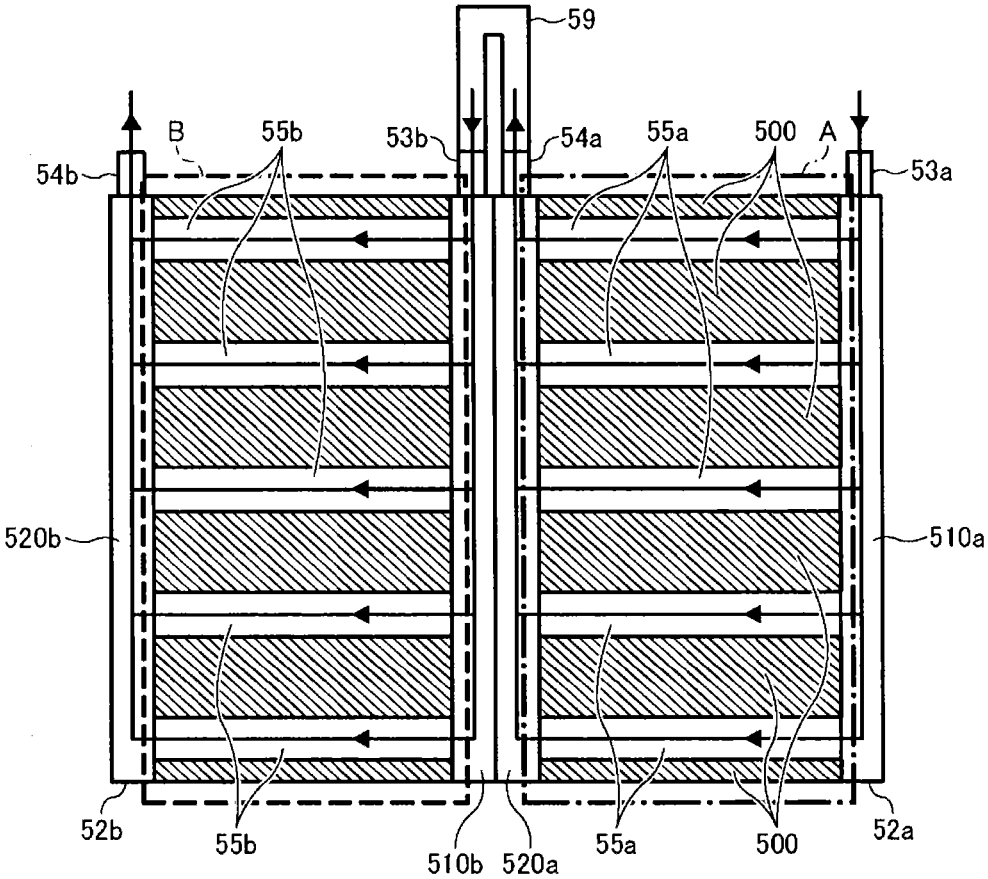
FIG. 8 is a diagram illustrating a schematic configuration of a radiator included in the developer cooling device according to the example of FIG. 7.

Next, a description is given of a different configuration of the image forming apparatus 100 according an example of this disclosure with reference to FIGS. 7 and 8.

FIG. 7 is a diagram illustrating a schematic configuration of the developer cooling device 50 according to this example. FIG. 8 is a diagram illustrating a schematic configuration of the radiator 52 included in the developer cooling device 50 according to this example.

The elements or units of the image forming apparatus 100 according to this example illustrated in FIGS. 7 and 8 are similar in structure and functions to the elements or units of the image forming apparatus 100 according to the example illustrated in FIGS. 1 through 6, except that the example illustrated in FIGS. 7 and 8 includes two heat releasing units in the heat releasing part 60 of the developer cooling device 50. Therefore, the elements or components of the image forming apparatus 100 according to FIGS. 7 and 8 may be denoted by the same reference numerals as those of the image forming apparatus 100 according to the example illustrated in FIGS. 1 through 6 and the descriptions thereof are omitted or summarized.

As illustrated in FIG. 7, the heat releasing part 60 of the developer cooling device 50 according to the example illustrated in FIGS. 7 and 8 includes a first radiator 52*a*, a second radiator 52*b*, a cooling fan 56, a cooling fan 56, and the liquid cooling duct 61.

The first radiator 52*a* and the second radiator 52*b* are heat releasing units. The first radiator 52*a* includes the first coolant conduits 55*a* and the air flowing paths 500. The second radiator 52*b* includes the second coolant conduits 55*b* and air flowing paths 500. The liquid cooling duct 61 includes the air intake port 62 and the air exhaust port 63. The first radiator 52*a*, the second radiator 52*b*, and the cooling fan 56 are disposed inside the liquid cooling duct 61 having the air intake port 62 and the air exhaust port 63 which are connected to an air vent that is formed on an exterior of the image forming apparatus 100.

Then, the cooling fan 56 intakes air outside the image forming apparatus 100 inside the liquid cooling duct 61 to be a cooling air. When the air passes through air flowing paths of the first radiator 52*a* and the second radiator 52*b*, heat exchange is performed between the coolant and the cooling air in the radiators 52*a* and 52*b*. Consequently, the air that has passed in the first radiator 52*a* and the second radiator 52*b* is exhausted from the air exhaust port 63 to the outside of the image forming apparatus 100.

Similar to the developer cooling device 50 according to the above-described example illustrated in FIGS. 5 and 6, the air intake port 62 of the liquid cooling duct 61 of the developer cooling device 50 according to the example illustrated in FIGS. 7 and 8 is disposed close to the air exhaust port 93 of the air cooling duct 91 of the fixing part cooling device 90. Therefore, part of air having a temperature raised by cooling the fixing device 33 and discharged from the air exhaust port 93 of the air cooling duct 91 of the fixing part cooling device 90 is taken in from the air intake port 62 of the liquid cooling duct 61 of the developer cooling device 50. As a result, the cooling air that passes through the air flowing paths of a first radiator 52*a* and a second radiator 52*b* provided to the developer cooling device 50 has temperature distribution depending on the position of the air flowing paths of the first radiator 52*a* and the second radiator 52*b* (e.g., a temperature distribution that is perpendicular to the cooling air flowing direction).

Further, the liquid cooling duct 61 has a configuration as illustrated in FIG. 8 in which the temperatures of the cooling air that passes in the first radiator 52*a* and the second radiator 52*b* are higher in the region A than the region B. As illustrated in FIG. 8, the first radiator 52*a* and the second radiator 52*b* correspond to the region A and the region B, respectively.

Further, the coolant flows in from the coolant inlet port 53*a* of the first radiator 52*a* and is divided in a coolant divider 510*a* to travel along arrows in the drawing in multiple coolant conduits 55*a* aligned in parallel to each other. The coolant divider 510*a* is connected to the coolant inlet port 53*a* and the multiple coolant conduits 55*a*. The multiple coolant conduits 55*a* function as coolant flowing paths of the coolant in the radiator 52*a*. After flowing in the multiple coolant conduits 55*a*, the coolant is merged in a coolant merger 520*a* and flows out (is discharged) from a coolant outlet port 54*a* of the first radiator 52*a*. The coolant merger 520*a* is connected to the multiple coolant conduits 55*a* and the coolant outlet port 54*a*.

Further, the coolant flows out from the coolant outlet port 54*a* of the first radiator 52*a* through the rubber tube 59. One end of the rubber tube 59 is connected to the coolant outlet port 54*a* of the first radiator 52*a* and the other end of the rubber tube 59 is connected to the coolant inlet port 53*b* of the second radiator 52*b* . The coolant entered the coolant inlet port 53*b* of the second radiator 52*b* is divided in a coolant divider 510*b* to travel along arrows in the drawing in the multiple coolant conduits 55*b* aligned in parallel to each other in the second radiator 52*b*. The coolant divider 510*b* is connected to the coolant inlet port 53*b* and the multiple coolant conduits 55*b*. After flowing in the multiple coolant conduits 55*b*, the coolant is merged in a coolant merger 520*b* and flows out (is discharged) from the coolant outlet port 54*b* of the second radiator 52*b*. The coolant merger 520*b* is connected to the multiple coolant conduits 55*b* and the coolant outlet port 54*b*.

Specifically, the first radiator 52*a* and the second radiator 52*b* are serially connected by the rubber tubes 59 so that the coolant enters from the coolant inlet port 53*a* of the first radiator 52*a* and exits from the coolant outlet port 54*b* of the second radiator 52*b*.

As described above, by including the first radiator 52*a* and the second radiator 52*b*, the developer cooling device 50 according to the example illustrated in FIGS. 7 and 8 can achieve the following effects.

Regarding the cooling air that flows in the air flowing paths of the first radiator 52*a* and the second radiator 52*b* serially connected to each other, the cooling air at high temperature in the air flowing paths of the first radiator 52*a* that is disposed at the upstream side of the coolant conduits in the cooling air flowing direction. As the coolant flows as described above, the cooling air high temperature can act on the first radiator 52*a* at the upstream side of the coolant conduits in the heat releasing part 60 reliably.

Therefore, when compared with the configuration in which the developer cooling device has no temperature distribution and the configuration in which the low temperature cooling air flows in the first radiator 52*a*, the configuration of the two radiators 52*a* and 52*b* illustrated in FIG. 7 can maintain a rate of decrease in temperature of the coolant within a preferable range even though the difference of the temperature of the cooling air flow and the temperature of the coolant in the first radiator 52*a* decreases.

In addition, the difference of the temperature of the cooling air and the temperature of the coolant in the second radiator 52*b* can be greater than the configuration in which the developer cooling device has no temperature distribution and the configuration in which the cooling air at high temperature flows in the second radiator 52*b*. Accordingly, the configuration provided with the first radiator 52*a* and the second radiator 52*b* can increase the difference of the temperature of the cooling air and the temperature of the coolant, and therefore the temperature of the coolant can be decreased in comparison with the configuration in which the cooling air at high temperature flows in the second radiator 52*b*.

For the above-described reasons, the configuration in which the cooling air at high temperature in the air flowing paths of the first radiator 52*a* can lower the temperature of the coolant that is discharged from the coolant outlet port 54*b* of the second radiator 52*b* more than the configuration in which the cooling air at low temperature in the air flowing paths of the first radiator 52*a*. Specifically, the configuration in which the cooling air at high temperature having the temperature distribution flows in the air flowing paths of the first radiator 52*a* can restrain the decrease in cooling performance of the developer cooling device 50 more than the configuration in which the cooling air at lower temperature having the temperature distribution flows in the air flowing paths of the first radiator 52*a*.

Accordingly, even when the developer cooling device 50 includes the heat releasing part 60 including the first radiator 52*a* and the second radiator 52*b* and the air exhaust port 93 of the fixing part cooling device 90 is disposed close to the air intake port 62 that intakes air that passes in the heat releasing part 60, the decrease in cooling performance can be prevented.

Next, a description is given of a different configuration of the image forming apparatus 100 according an example of this disclosure with reference to FIGS. 9 through 13.

Figure 9:
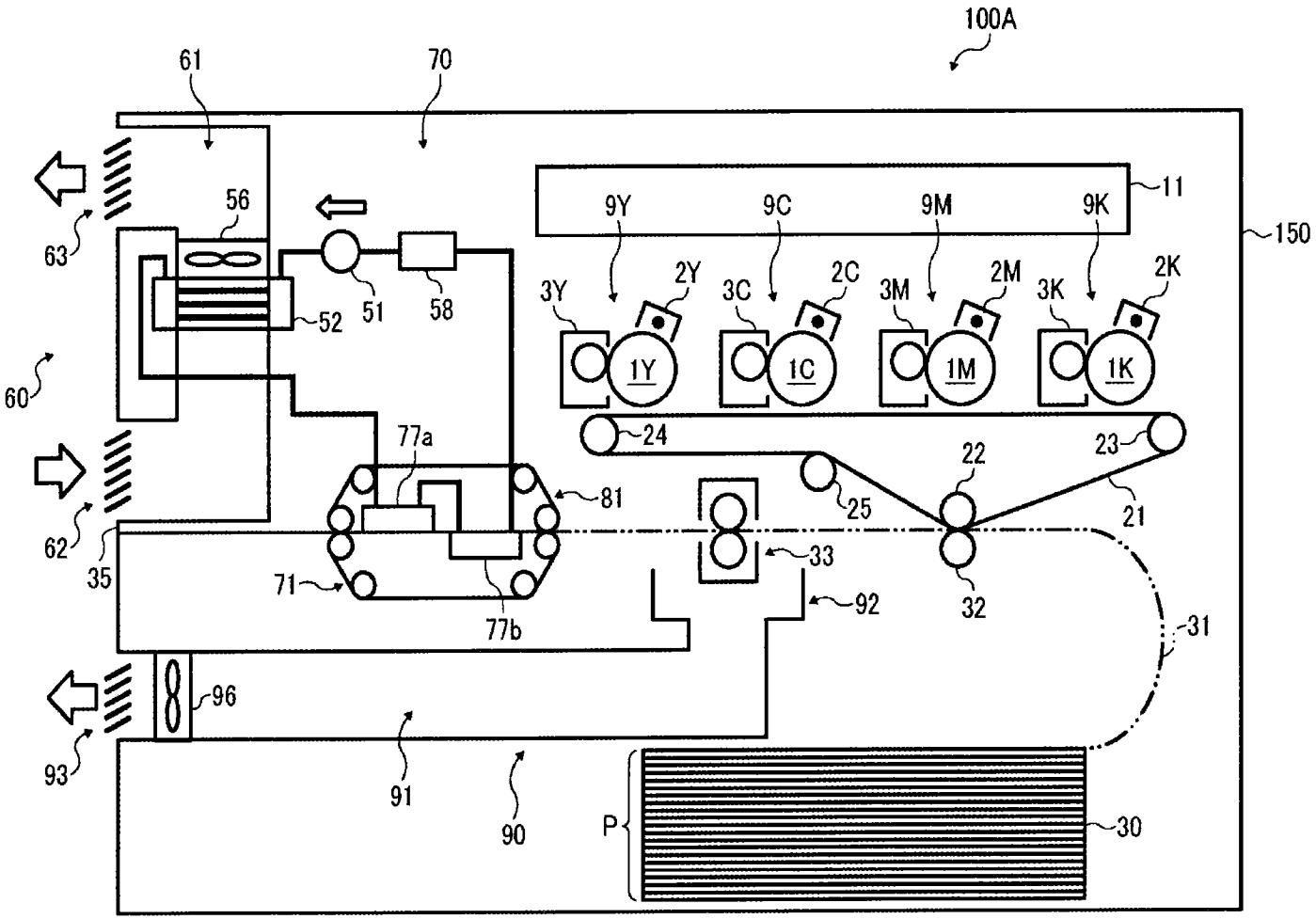
FIG. 9 is a diagram illustrating a schematic configuration of an image forming apparatus according to yet another example.
Figure 10:
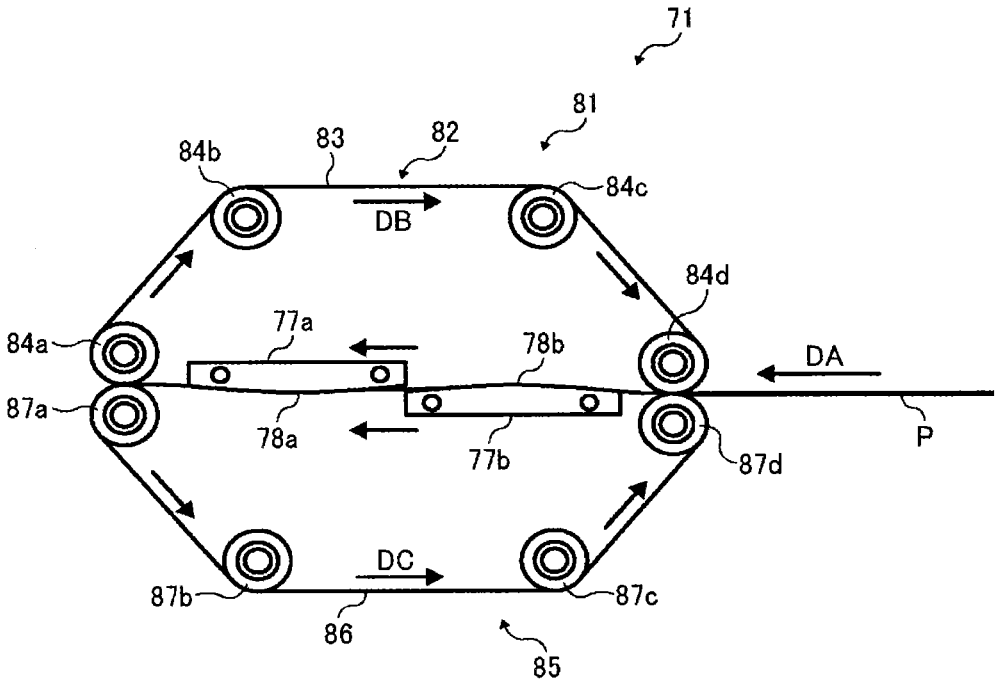
FIG. 10 is a diagram illustrating a configuration of a sheet cooling part according to the example of FIG. 9.
Figure 11:
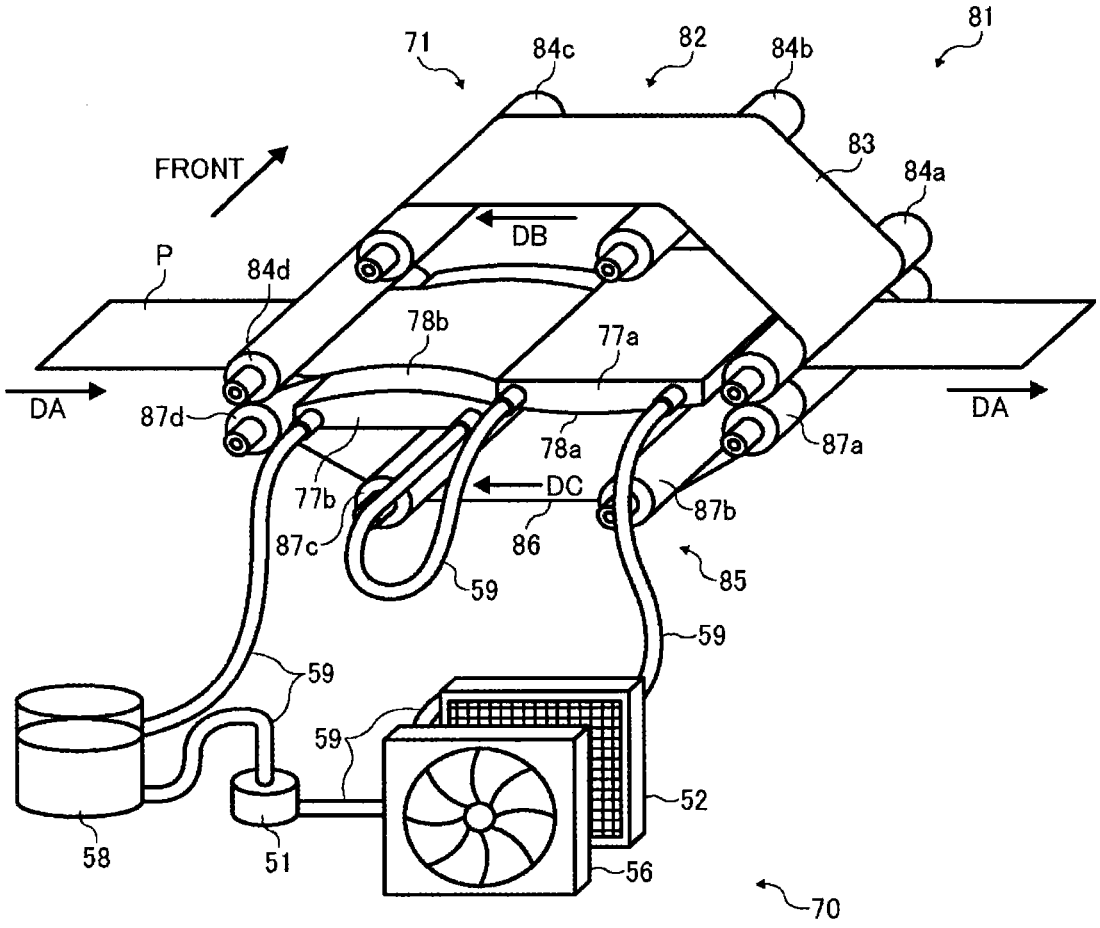
FIG. 11 is a perspective view illustrating the configuration of the sheet cooling part according to the example of FIG. 9.
Figure 12:
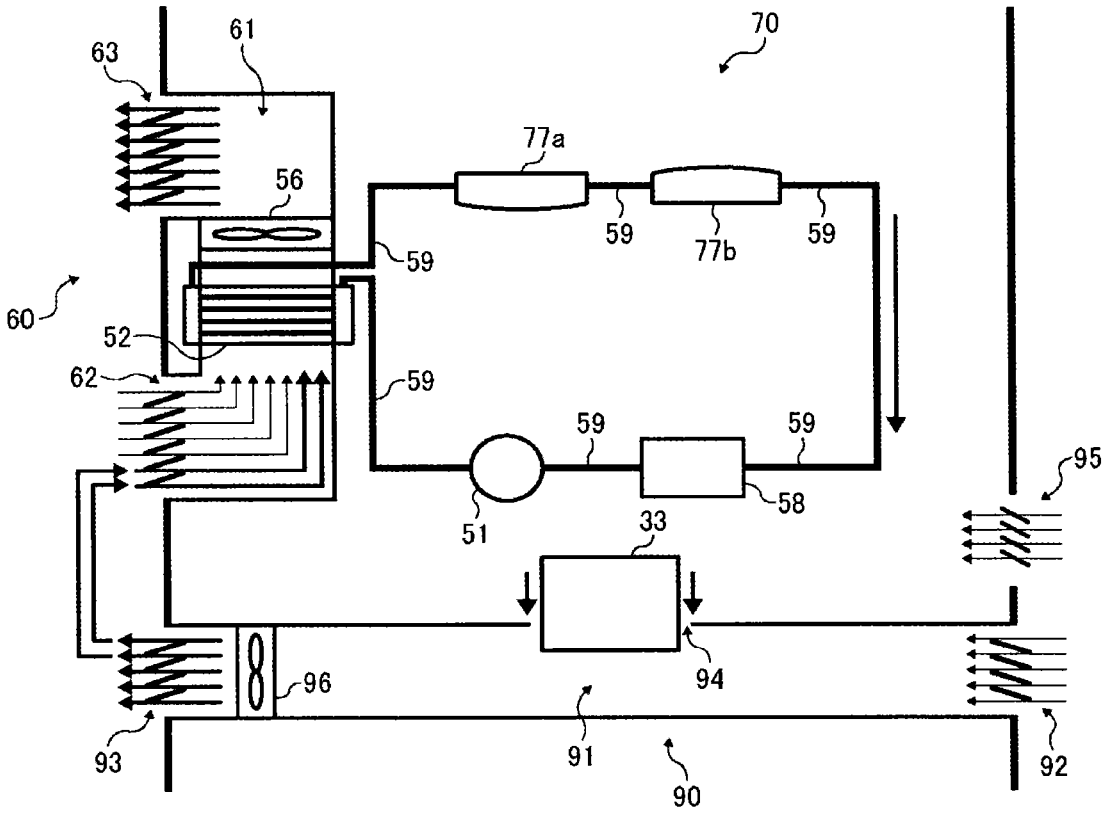
FIG. 12 is a diagram illustrating a schematic configuration of a sheet cooling device according to the example of FIG. 9.
Figure 13:
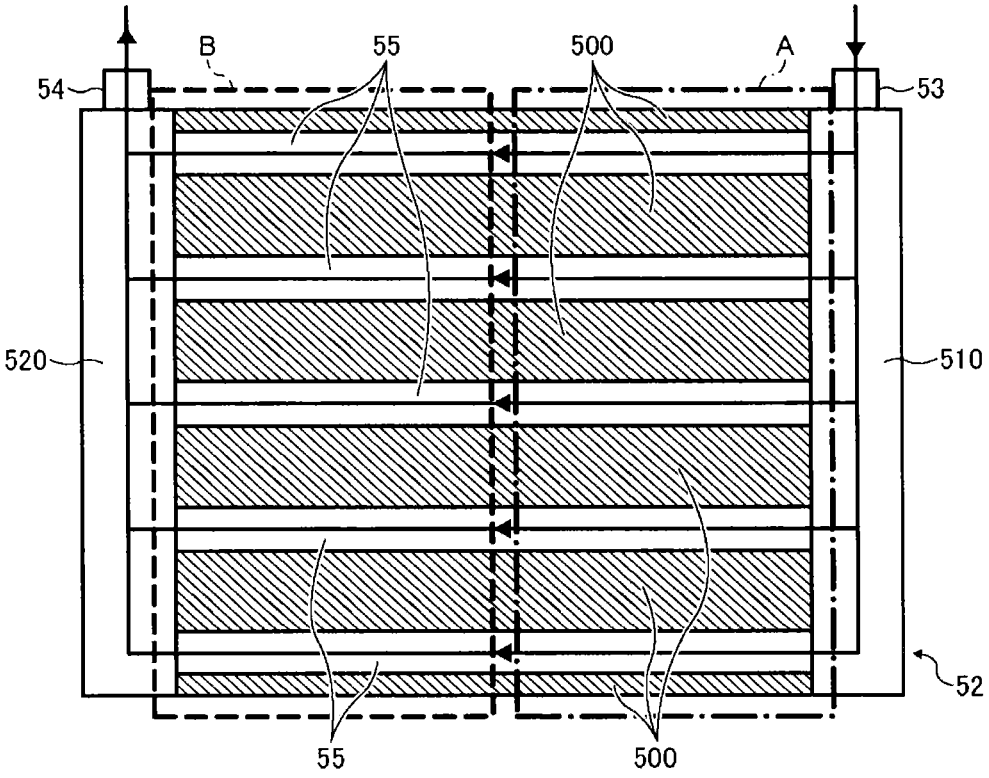
FIG. 13 is a diagram illustrating a radiator included in the sheet cooling device according to the example of FIG. 9.

FIG. 9 is a diagram illustrating a schematic configuration of the image forming apparatus 100 according to this embodiment illustrated in FIGS. 9 through 13. FIG. 10 is a diagram illustrating a configuration of a sheet cooling part 71 according to a sheet cooling device 70 according to this example. FIG. 11 is a perspective view illustrating the configuration of the sheet cooling part 71 according to this embodiment. FIG. 12 is a diagram illustrating a schematic configuration of the sheet cooling device 70 according to this embodiment. FIG. 13 is a diagram illustrating the radiator 52 included in the sheet cooling device 70 according to this embodiment.

The elements or units of the image forming apparatus 100 according to this example illustrated in FIGS. 9 through 13 are similar in structure and functions to the elements or units of the image forming apparatus 100 according to the example illustrated in FIGS. 1 through 6 and the example illustrated in FIGS. 7 and 8, except that the example illustrated in FIGS. 9 through 13 includes a sheet cooling device 70 that functions as a cooling device to cool a cooling target, which is the sheet P having the toner image fixed by the fixing device 33 in this example. Therefore, the elements or components of the image forming apparatus 100 according to FIGS. 9 through 13 may be denoted by the same reference numerals as those of the image forming apparatus 100 according to the example illustrated in FIGS. 1 through 6 and the example illustrated in FIGS. 7 and 8 and the descriptions thereof are omitted or summarized.

As illustrated in FIG. 9, the sheet conveying device 70 according to the present embodiment includes two cooling members, which are an upper cooling member 77*a* and a lower cooling member 77*b* functioning as heat receiving units. The upper cooling member 77*a* and the lower cooling member 77*b* absorb heat from the sheet P that is held therebetween and conveyed by a belt conveying unit 81 and cool the sheet P. That is, the sheet cooling part 71 that functions as a heat receiving part of the sheet cooling device 70 includes the belt conveying unit 81, and the upper cooling member 77*a* and the lower cooling member 77*b* functioning as heat receiving units which are cooling members.

As illustrated in FIG. 10, the belt conveying unit 81 includes an upper belt unit 82 and a lower belt unit 85. In FIG. 10, the upper belt unit 82 endlessly moves an upper conveying belt 83 that is disposed on an upper face of the sheet P and the lower belt unit 85 endlessly moves a lower conveying belt 86 that is disposed on a lower face of the sheet P.

The upper cooling member 77*a* that functions as an upper heat receiving unit to draw heat from the upper face of the sheet P is disposed on an inner circumferential surface of the upper conveying belt 83, and the lower cooling member 77*b* that functions as a lower heat receiving unit to draw heat from the lower face of the sheet P is disposed on an inner circumferential surface of the lower conveying belt 86.

Respective positions of the upper cooling member 77*a* and the lower cooling member 77*b* are shifted in a sheet conveying direction of the sheet P. Further, a lower surface of the upper cooling member 77*a* is an upper heat absorbing surface 78*a* having a convex shape and an upper surface of the lower cooling member 77*b* is a lower heat absorbing surface 78*b* having a convex shape. The upper heat absorbing surface 78*a* is a slightly outwardly extended surface on which an inner circumference of the upper conveying belt 83 slides. The lower heat absorbing surface 78*b* is a slightly outwardly extended surface on which an inner circumference of the lower conveying belt 86 slides. It is to be noted that the shape of the heat absorbing surfaces are not limited to a convex shape. For example, the heat absorbing surface of the above-described configuration can be a flat shape, for example. Further, both the upper cooling member 77*a* and the lower cooling member 77*b* includes coolant conduits inside.

The upper belt unit 82 includes four belt tension rollers 84*a*, 84*b*, 84*c*, and 84*d*. The upper conveying belt 83 is spanned around the belt tension rollers 84*a*, 84*b*, 84*c*, and 84*d* to endlessly move in a clockwise direction indicated by arrow DB in FIG. 10.

By contrast, the lower belt unit 85 includes four belt tension rollers 87*a*, 87*b*, 87*c*, and 87*d*. The lower conveying belt 86 is spanned around the belt tension rollers 87*a*, 87*b*, 87*c*, and 87*d* to endlessly move in a counterclockwise direction indicated by arrow DC in FIG. 10.

In accordance to endless rotations of the upper conveying belt 83 and the lower conveying belt 86, the sheet P is conveyed in a direction indicated by arrow DA in FIG. 10 while being held by the upper conveying belt 83 and the lower conveying belt 86.

It is to be noted that, in order to drive each conveying belt, the belt tension roller 87*a* of the lower belt unit 85 functions as a drive roller and the belt tension rollers 87*b*, 87*c*, and 87*d* of the lower belt unit 85 function as driven rollers, so that a drive motor rotates the belt tension roller 87*a* to move the lower conveying belt 86 endlessly. Further, the belt tension rollers 84*a*, 84*b*, 84*c*, and 84*d* extending the upper conveying belt 83 which function as driven rollers, so that the upper conveying belt 83 that contacts the lower conveying belt 86 directly or via the sheet P is moved endlessly.

Next, a detailed description is given of the sheet cooling device 70 according to FIG. 11.

As illustrated in FIG. 11, the sheet cooling device 70 includes cooling devices and components, for example, the cooling part 71, the upper cooling member 77*a*, the lower cooling member 77*b*, the radiator 52, the cooling fan 56, the coolant feed pump 51, the reserve tank 58, and the multiple rubber tubes 59.

The sheet cooling part 71 absorbs (receives) heat from the sheet P (the cooling target) having the high temperature after the fixing operation at the fixing device 33. The upper cooling member 77*a* and the lower cooling member 77*b* are included in the sheet cooling part 71 and function as heat receiving units. The radiator 52 is a heat releasing unit of the heat releasing part 60 to release heat absorbed by the sheet cooling part 71. The cooling fan 56 causes outside air to hit the radiator 52 forcibly, so that the cooling performance of the sheet cooling device 70 is enhanced. The coolant feed pump 51 functions as a coolant feeding unit to circulate the coolant between the upper cooling member 77*a* and the lower cooling member 77*b* of the sheet cooling part 71 and the radiator 52 of the heat releasing part 60. The reserve tank 58 reserves the coolant therein and can be detached during maintenance.

As illustrated in FIG. 11, the multiple rubber tubes 59 of the sheet cooling device 70 function as outer coolant conduits to circulate the coolant by connecting the coolant feed pump 51, the radiator 52, the upper cooling member 77*a*, the lower cooling member 77*b*, and the reserve tank 58. The multiple rubber tubes 59 also form circulating paths to circulate the coolant by serially connecting the coolant feed pump 51, the radiator 52, the upper cooling member 77*a*, the lower cooling member 77*b*, and the reserve tank 58. The coolant travels in the coolant feed pump 51, the radiator 52, the upper cooling member 77*a*, the lower cooling member 77*b*, and the reserve tank 58, which are connected by the multiple rubber tubes 59. Specifically, the coolant is fed from the coolant feed pump 51, flows in the radiator 52, the upper cooling member 77*a*, the lower cooling member 77*b*, and the reserve tank 58, and returns to the coolant feed pump 51.

It is to be noted that each of the multiple rubber tubes 59 connects other cooling devices and components as follows, thereby forming the circulating path of the coolant. Specifically, of the multiple rubber tubes 59, one rubber tube 59 connects a liquid outlet port of the coolant feed pump 51 and the coolant inlet port 53 (refer to FIG. 13) of the radiator 52. Another rubber tube 59 connects the coolant outlet port 54 (refer to FIG. 13) of the radiator 52 and a liquid inlet port of the upper cooling member 77*a*. Yet another rubber tube 59 connects a liquid outlet port of the upper cooling member 77*a* and a liquid inlet port of the lower cooling member 77*b*. Yet another rubber tube 59 connects a liquid outlet port of the lower cooling member 77*b* and a liquid inlet port of the reserve tank 58. Yet another rubber tube 59 connects a liquid outlet port of the reserve tank 58 and a liquid inlet port of the coolant feed pump 51.

Next, a description is given of operations of the sheet cooling device 70 having the above-described configuration.

When cooling the sheet P, that is, when holding the sheet P by the belt conveying unit 81, the upper belt unit 82 and the lower belt unit 85 are disposed close to each other, as illustrated in FIG. 10. According to this configuration, when a sheet conveyance defect (e.g., a paper jam) occurs in the belt conveying unit 81 included in the image forming apparatus 100 according to this example illustrated in FIG. 10, the sheet P that is halted or jammed in the belt conveying unit 81 can be removed by separating the upper belt unit 82 and the lower belt unit 85. In a state illustrated in FIG. 10, as the belt tension roller 87*a* that functions as a drive roller of the lower belt unit 85 is rotated, the upper conveying belt 83 and the lower conveying belt 86 endlessly move in the direction DB (the upper side of the belt conveying unit 81) and the direction DC (the lower side of the belt conveying unit 81), respectively, in FIG. 10. As a result, the sheet P held between the upper conveying belt 83 and the lower conveying belt 86 is conveyed in the direction DA in FIG. 10.

In the sheet cooling device 70 according to this example, when the sheet P is held and conveyed by the belt conveying unit 81 of the sheet cooling part 71, the belt conveying unit 81 receives heat from the sheet P. Therefore, the coolant is circulated between the upper cooling member 77*a* and the lower cooling member 77*b* of the belt conveying unit 81 and the radiator 52 by driving the coolant feed pump 51. Specifically, driving of the coolant feed pump 51 causes the coolant to flow in the coolant conduits of the upper cooling member 77*a* and the lower cooling member 77*b*.

At this time, the inner circumferential surface of the upper conveying belt 83 of the upper belt unit 82 slides on the upper heat absorbing surface 78*a* of the upper cooling member 77*a* and the inner circumferential surface of the lower conveying belt 86 of the lower belt unit 85 slides on the lower heat absorbing surface 78*b* of the lower cooling member 77*b*.

With this configuration, the lower cooling member 77*b* receives heat of the sheet P from the lower surface of the sheet P via the lower conveying belt 86 and the upper cooling member 77*a* receives heat of the sheet P from the upper surface of the sheet P via the upper conveying belt 83. Then, the coolant transfers the amount of heat of the sheet P received by the upper cooling member 77*a* and the lower cooling member 77*b* to the outside of the image forming apparatus 100, thereby maintaining relatively low temperature of the upper cooling member 77*a* and the lower cooling member 77*b*.

Specifically, by driving the coolant feed pump 51, the coolant circulates between the upper cooling member 77*a* and the lower cooling member 77*b* of the sheet cooling part 71 and the radiator 52. According to this circulation, the coolant that flows in the coolant conduits of the upper cooling member 77*a* and the lower cooling member 77*b* absorbs heat from the upper cooling member 77*a* and the lower cooling member 77*b*, and therefore the temperature of the coolant increases. The amount of heat of the coolant is released to the outside of the image forming apparatus 100 when the coolant passes in the radiator 52, so that the temperature of the coolant decreases. Then, when the coolant having the low temperature flows in the coolant conduits of the upper cooling member 77*a* and the lower cooling member 77*b* again, the coolant receives the heat of the sheet P received by the upper cooling member 77*a* and the lower cooling member 77*b* via the upper conveying belt 83 and the lower conveying belt 86.

By repeating the above-described cycle of the coolant, the sheet P is cooled from the upper side and the lower side thereof.

In the sheet cooling device 70 according to this example, cooling of the sheet P as described above can prevent the sheet P from being stacked in the sheet discharging tray while the sheet P keeps the heat. Consequently, the toner blocking can be prevented effectively, so that the sheet P can be stacked in the sheet discharging tray while adjacent stacked sheets P do not stick to each other.

As illustrated in FIG. 12, in addition to the sheet cooling device 70 that cools the sheet P as a cooling target having a relatively high temperature after the fixing operation, the image forming apparatus 100 according to this example includes the fixing part cooling device 90 that cools air around the fixing device 33, which is substantially the same as the fixing part cooling device 90 according to the example illustrated in FIG. 5 and the example illustrated in FIG. 7.

The sheet P as a cooling target of the sheet cooling device 70 is cooled with the liquid cooling method as described above.

By contrast, the air around the fixing device 33 that is a cooling target of the fixing part cooling device 90 is cooled with a known air cooling method.

It is to be noted that the fixing part cooling device 90 according to this example illustrated in FIG. 12 has the same configuration as the fixing part cooling device 90 according to the example illustrated in FIG. 5 and the example illustrated in FIG. 7. Therefore, descriptions of the configuration and functions of the fixing part cooling device 90 according to this example are omitted.

Consequently, the temperature of the air that is discharged from the air exhaust port 93 by driving the air cooling discharging fan 96 of the fixing part cooling device 90 is increased. When discharged from the air exhaust port 93, part of the air having the temperature raised by cooling the fixing device 33 is taken in from the air intake port 62 of the liquid cooling duct 61 of the sheet cooling device 70 since the air intake port 62 is disposed in the vicinity of the air exhaust port 93. As a result, the cooling air that passes from the air flowing paths of the radiator 52 of the sheet cooling device 70 has temperature distribution depending on the position of the air flowing paths of the radiator 52.

Specifically, the liquid cooling duct 61 as illustrated in FIG. 13 is arranged so that a temperature of the cooling air that passes air flowing paths 500 of the radiator 52 is higher in the region A than in the region B. Then, in the radiator 52 as illustrated in FIG. 13, the coolant flows in (is supplied) from the coolant inlet port 53 that functions as a coolant inlet port of the coolant close to the region A and is divided in the coolant divider 510 to travel along arrows in the drawing in the multiple coolant conduits 55 aligned in parallel to each other. The coolant divider 510 is connected to the coolant inlet port 53 and the multiple coolant conduits 55. The multiple coolant conduits 55 function as coolant flowing paths of the coolant in the radiator 52. After flowing in the region B, the coolant is merged in the coolant merger 520 and flows out (is discharged) from the coolant outlet port 54 that functions as a coolant outlet port of the coolant from the radiator 52. The coolant merger 520 is connected to the multiple coolant conduits 55 and the coolant outlet port 54.

That is, while the coolant flows in the radiator 52 by entering from the coolant inlet port 53, passing in the multiple coolant conduits 55 and the cooling fins of the air flowing paths 500 through which the air flows, and exiting from the coolant outlet port 54, the coolant flows from the region A having the cooling air at high temperature to the region B having the cooling air at low temperature.

Accordingly, by including the above-described radiator 52, the coolant moves from the region A where the temperature of the cooling air that passes through the air flowing paths 500 of the radiator 52 is high to the region B where the temperature of the cooling air is low. Therefore, the difference of temperature of the cooling air that exchanges heat with the coolant can be most increased. Therefore, even if the cooling air that passes through the air flowing paths 500 of the radiator 52 have temperature distribution, which is the same as the example illustrated in FIG. 5 and the example illustrated in FIG. 7, the temperature of the coolant can be decreased most efficiently.

Next, a description is given of a different configuration of the image forming apparatus 100A according an example of this disclosure with reference to FIGS. 14 through 17.

Same as the image forming apparatus 100, the image forming apparatus 100A may be a copier, a facsimile machine, a printer, a plotter, a multifunction peripheral or a multifunction printer (MFP) having at least one of copying, printing, scanning, facsimile, and plotter functions, or the like. According to the present example, the image forming apparatus 100A is an electrophotographic printer that forms color and monochrome toner images on a sheet or sheets by electrophotography.

More specifically, the image forming apparatus 100A functions as a printer. However, the image forming apparatus 100A can expand its function as a copier by adding a scanner as an option disposed on top of an apparatus body of the image forming apparatus 100A. The image forming apparatus 100A can further obtain functions as a facsimile machine by adding an optional facsimile substrate in the apparatus body of the image forming apparatus 100A.

Figure 14:
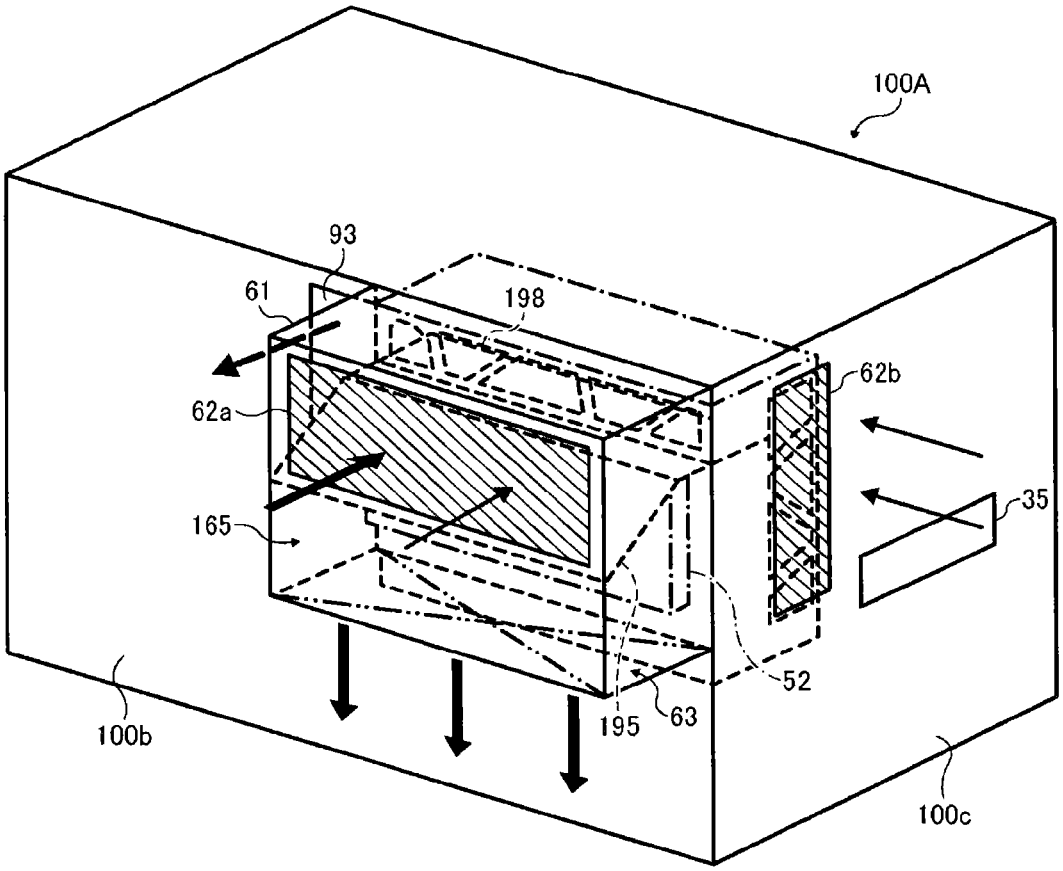
FIG. 14 is a perspective back view illustrating an image forming apparatus according to another example.
Figure 15:
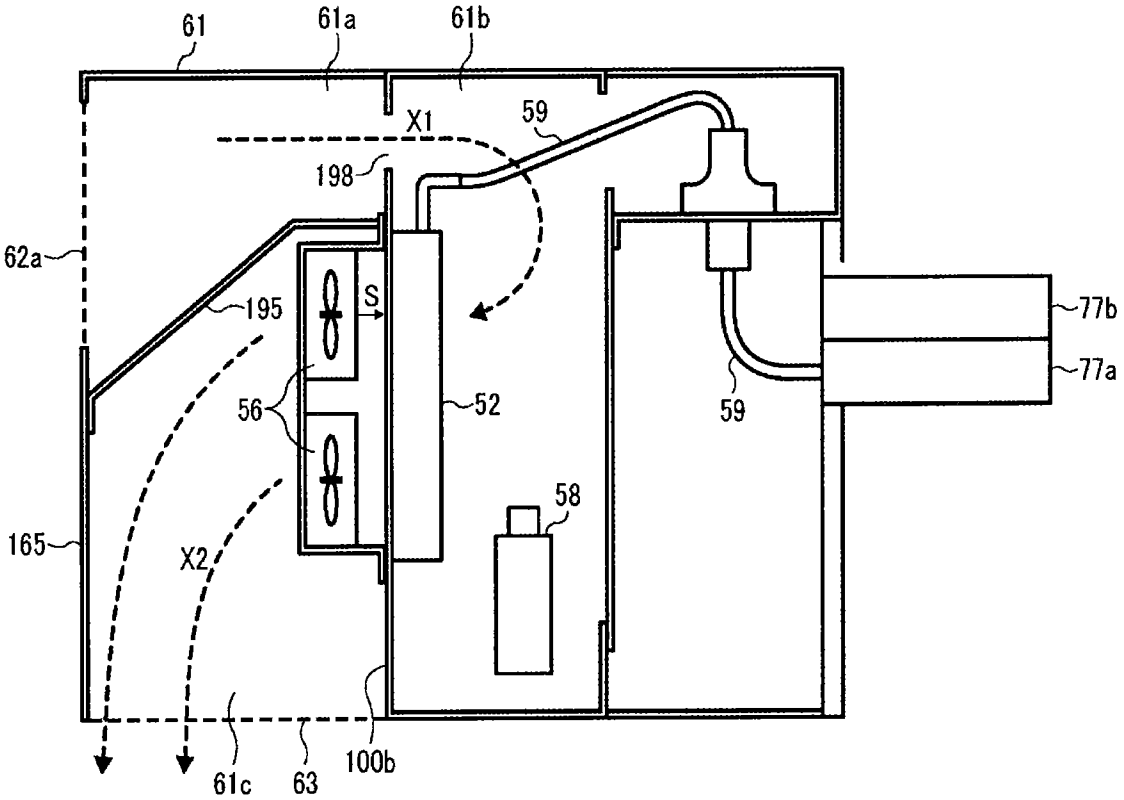
FIG. 15 is a cross-sectional right view illustrating a schematic configuration of the image forming apparatus according to the example of FIG. 14.
Figure 16:
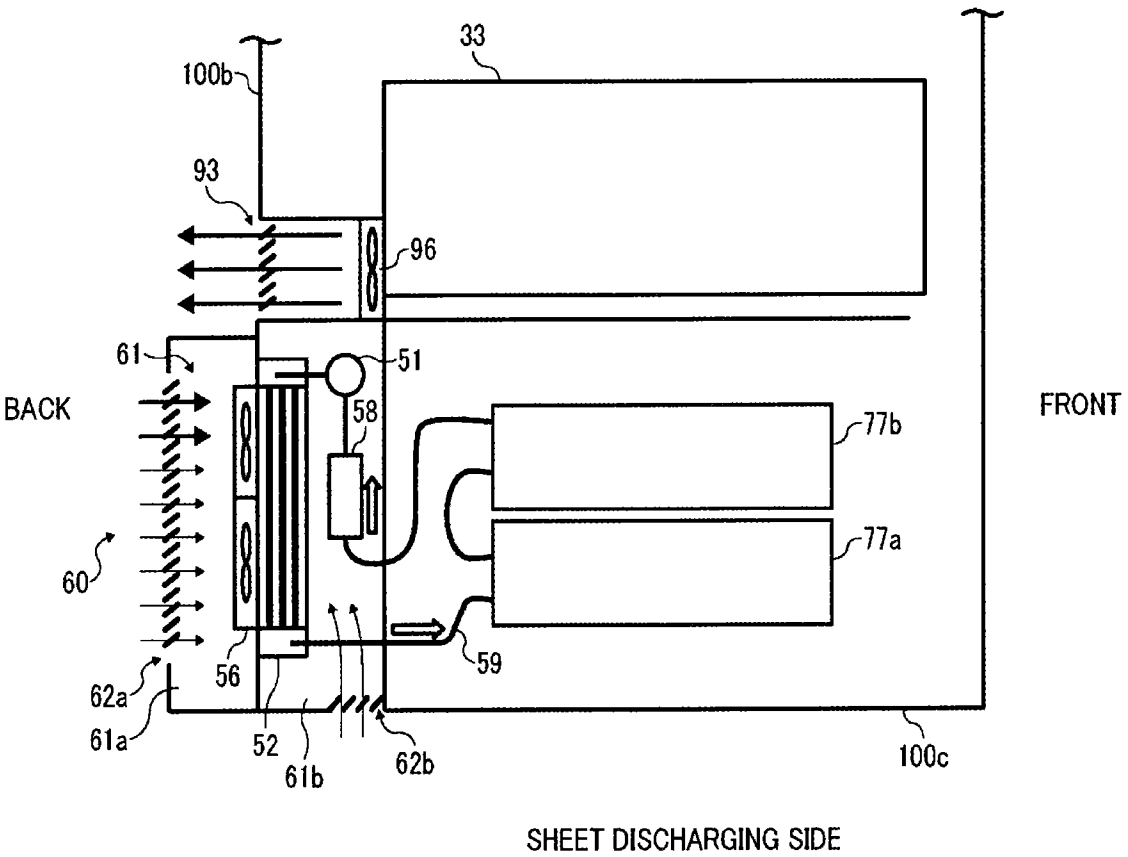
FIG. 16 is a top view illustrating a schematic configuration of the image forming apparatus according to the example of FIG. 14.
Figure 17:
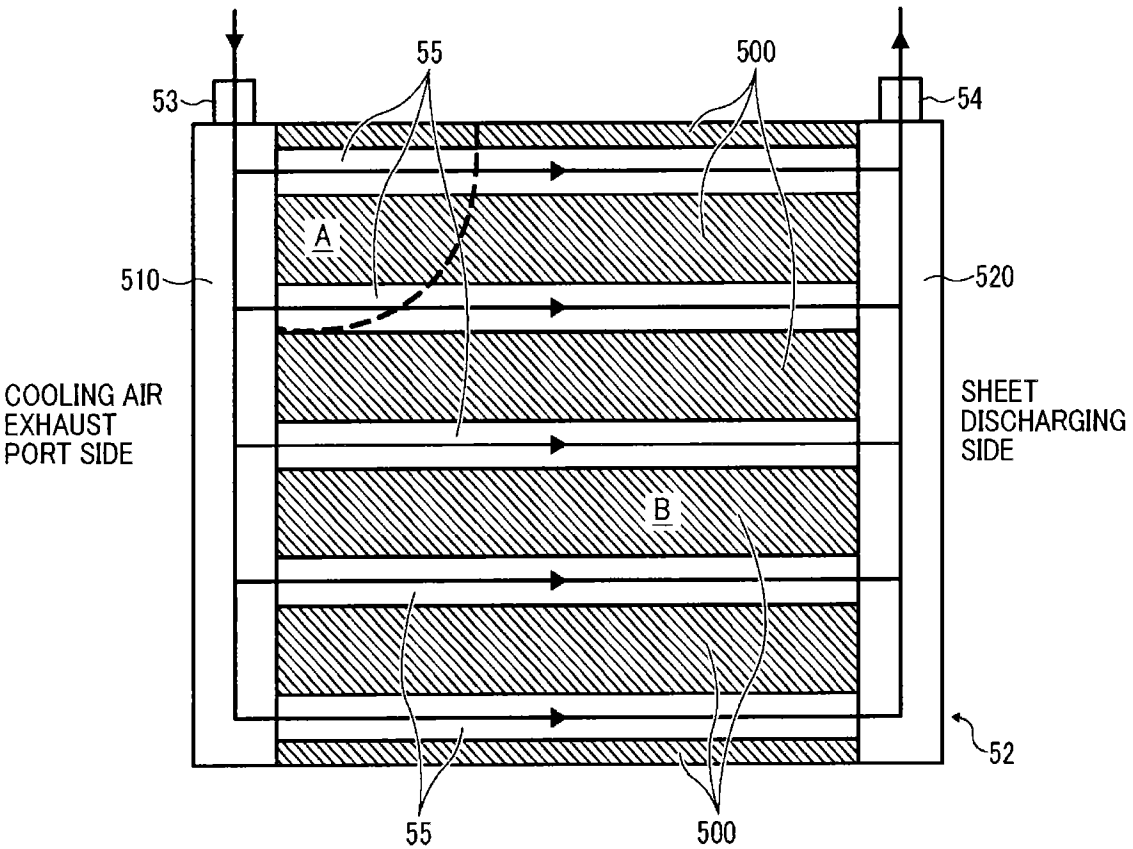
FIG. 17 is a diagram illustrating a radiator included in the sheet cooling device according to the example of FIG. 14.

FIG. 14 is a perspective back view illustrating the image forming apparatus 100A according to this example. FIG. 15 is a cross-sectional right view illustrating a schematic configuration of the image forming apparatus 100A of FIG. 14. FIG. 16 is a top view illustrating a schematic configuration of the image forming apparatus 100A of FIG. 14. FIG. 17 is a diagram illustrating the radiator 52 included in the sheet cooling device 70 according to this example.

The elements or units of the image forming apparatus 100A according to this example illustrated in FIGS. 14 through 17 are basically similar in structure and functions to the elements or units of the image forming apparatus 100A according to the example illustrated in FIGS. 9 through 13. Therefore, the elements or components of the image forming apparatus 100A according to FIGS. 14 through 17 may be denoted by the same reference numerals as those of the image forming apparatus 100A according to the example illustrated in FIGS. 9 through 13 and the descriptions thereof are omitted or summarized.

As illustrated in FIG. 14, the image forming apparatus 100A according to this example includes the sheet cooling device 70, a part of which projects outwardly from a back 100*b* of the image forming apparatus 100A. Further, the sheet cooling device 70 includes two air intake ports, which are a first air intake port 62*a* and a second air intake port 62*b*. The first air intake port 62*a* functions as a back air inlet port that is provided on a back of a projection 165, which is the part of the sheet cooling device 70 projecting from the back 100*b* of the image forming apparatus 100A. The second air intake port 62*b* functions as a side air inlet port that is provided on a sheet discharging side 100*c* of the image forming apparatus 100A. The air exhaust port 63 of the sheet cooling device 70 is provided on a lower side of the projection 165.

As illustrated in FIGS. 14 and 16, the air exhaust port 93 of the fixing part cooling device 90 is provided on the back 100*b* of the image forming apparatus 100A so as to be adjacent to the projection 165 of the sheet cooling device 70. Same as the above-described examples, in this example illustrated in FIGS. 14 through 17, the air having the temperature increased after the fixing device 33 is cooled by driving of the air cooling discharging fan 96 can be exhausted from the air exhaust port 93.

As illustrated in FIG. 15, an interior part of the projection 165 of the sheet cooling device 70 is divided vertically by a partition 195. The liquid cooling duct 61 of the sheet cooling device 70 includes a first chamber 61*a*, a second chamber 61*b*, and a third chamber 61*c*. The first chamber 61*a* is an upper part of space in the projection 165 that is divided vertically by the partition 195 and the third chamber 61*c* is a lower part of space in the projection 165. The second chamber 61*b* of the liquid cooling duct 61 is an air flowing space provided in the apparatus body 150 of the image forming apparatus 100A.

As the cooling fan 56 rotates, the air outside of the image forming apparatus 100A is drawn from the first air intake port 62*a* into the first chamber 61*a*. The air taken into the first chamber 61 a flows through an opening 198 that is provided on the back 100*b* of the image forming apparatus 100A to the second chamber 61*b* as indicated by arrow X1 as illustrated in FIG. 15. Then, the direction of the air is reversed in the second chamber 61*b* to be guided to the radiator 52.

Further, as the cooling fan 56 rotates, the air outside of the image forming apparatus 100A is drawn from the second air intake port 62*b*. The air taken into the second air intake port 62*b* is guided to the second chamber 61*b* (refer to FIG. 16). After the cooling air guided by the first air intake port 62*a* and the cooling air guided by the second air intake port 62*b* are merged in the second chamber 61*b*, the merged cooling air moves to the third chamber 61*c* passing through the air flowing paths 500 of the radiator 52 (refer to FIG. 17). Then, the cooling air is discharged from the air exhaust port 63 to the outside of the image forming apparatus 100 as indicated by arrow X2 as illustrated in FIG. 15.

As illustrated in FIG. 16, the air exhaust port 93 of the fixing part cooling device 90 is provided adjacent to the projection 165 of the sheet cooling device 70. Same as the above-described examples, in this example illustrated in FIGS. 14 through 17, the air having the temperature increased after the fixing device 33 is cooled by driving of the air cooling discharging fan 96 can be exhausted from the air exhaust port 93, and part of the air having the temperature raised by cooling the fixing device 33 is taken in from the first air intake port 62*a* since the first air intake port 62*a* is disposed in the vicinity of the air exhaust port 93. As a result, the cooling air that passes from the air flowing paths 500 of the radiator 52 of the sheet cooling device 70 has temperature distribution depending on the position of the air flowing paths 500 of the radiator 52. Specifically, the temperature of the cooling air that passes air flowing paths 500 of the radiator 52 is higher in the region A than in the region B in FIG. 17.

The following description shows reasons why the temperature of the cooling air that passes in the region A is higher than the temperature of the other areas or regions.

The radiator 52 illustrated in FIG. 17 is viewed from a side to which the cooling air moves (a direction indicated by an arrow S illustrated in FIG. 15). Specifically, the right side of the drawing is a sheet discharging side (i.e., the sheet discharging side 100*c*) and the left side of the drawing is a cooling air exhaust port side where the air exhaust port 93 is disposed. Part of the air having the temperature raised by cooling the fixing device 33 is taken in from the cooling air exhaust port side of the first air intake port 62*a* to the liquid cooling duct 61. Therefore, the cooling air of the first air intake port 62*a* taken in through the opening 198 to the second chamber 61*b* of the liquid cooling duct 61 has the temperature distribution with a higher temperature at the cooling air exhaust port side. As described above, the outside air taken in from the second air intake port 62*b* is guided from the sheet discharging side to the second chamber 61*b*, and therefore is mixed with the cooling air from the first air intake port 62*a*. At this time, the cooling air from the first air intake port 62*a* at the upper part of the radiator 52 illustrated in FIG. 17 flows in without moving in the second chamber 61*b*. Therefore, the cooling air from the first air intake port 62*a* at the upper part of the radiator 52 is not mixed with the cooling air from the second air intake port 62*b* at the second chamber 61*b*. Consequently, the cooling air at the upper part of the radiator 52 has the temperature distribution with the higher temperature at the cooling air exhaust port side. As a result, the temperature of the cooling air in the region A at the upper part of the radiator 52 and on the cooling air exhaust port side is higher than the temperature of the cooling air in the other areas or regions.

By contrast, the cooling air from the first air intake port 62*a* at the lower part of the radiator 52 moves downwardly in the second chamber 61*b* and flows into the radiator 52. While moving in the second chamber 61*b*, the cooling air from the first air intake port 62*a* at the lower part of the radiator 52 is mixed with the cooling air from the second air intake port 62*b* at the lower part of the radiator 52 sufficiently, so as to have uniform temperature distribution. As a result, the temperature of the cooling air at the lower part of the radiator 52 does not become high.

For the above-described reasons, the temperature of the cooling air that passes in the upper part of the radiator 52 and in the region A on the cooling air exhaust port side becomes higher than the temperature of the other areas or regions.

Accordingly, the radiator 52 in this example illustrated in FIGS. 14 through 17 includes the coolant inlet port 53 that functions as a coolant inlet port of the coolant disposed in the vicinity of the regions A, so that the coolant having the temperature increased after cooling the sheet P flows from the coolant inlet port 53 in the vicinity of the region A. The coolant entered from the coolant inlet port 53 in the vicinity of the region A flows along arrows in FIG. 17 in the multiple coolant conduits 55 that function as coolant conduits in the radiator 52 and disposed in parallel to each other. After having reached the regions B, the coolant flows out (is discharged) through the coolant outlet port 54 that functions as a coolant outlet port of the coolant. By so doing, the coolant in the coolant conduits 55 of the radiator 52 according to the present example can flow from the region A having the cooling air at high temperature to the region B having the cooling air at low temperature in the air flowing paths 500. Accordingly, the difference of the temperature of the coolant and the temperature of the cooling air, which perform heat exchange therebetween, can be maximized. As a result, same as the above-described examples, even if the cooling air that passes in the air flowing paths 500 of the radiator 52 has the temperature distribution, the temperature of the coolant can be reduced most efficiently.

Figure 18:
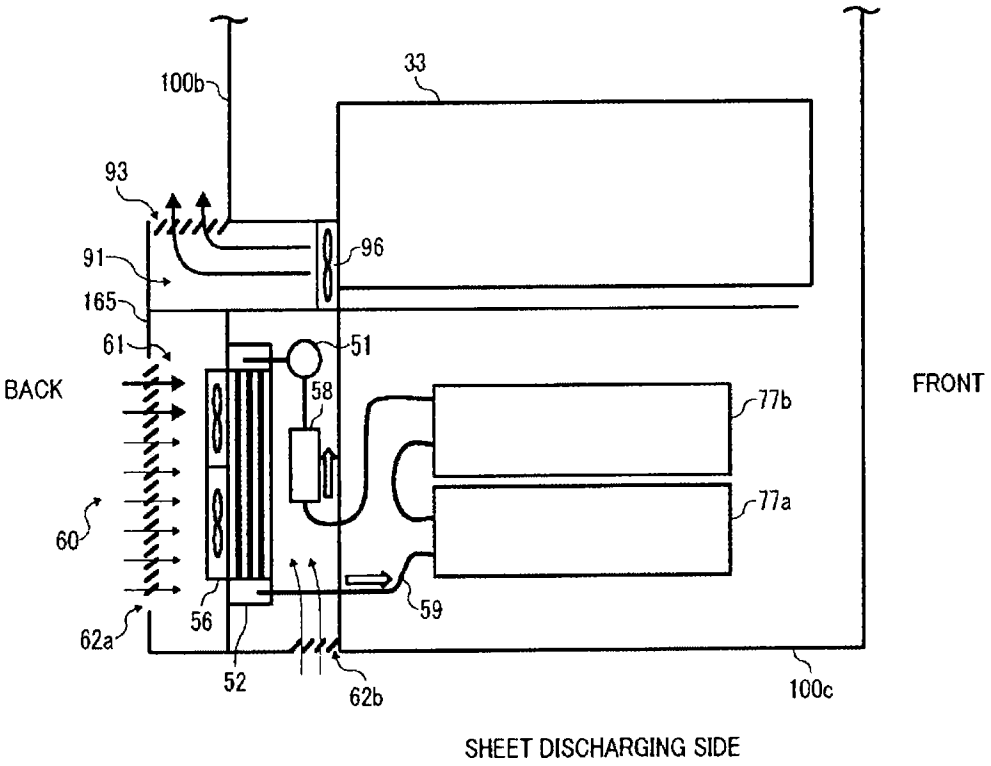
FIG. 18 is a top view illustrating a schematic configuration of a sheet discharging side of an image forming apparatus according to another example.

Next, a description is given of a different configuration of the image forming apparatus 100A according an example of this disclosure with reference to FIG. 18.

FIG. 18 is a top view illustrating a schematic configuration of the sheet discharging side of the image forming apparatus 100A according to this example.

The elements or units of the image forming apparatus 100A according to this example illustrated in FIG. 18 are similar in structure and functions to the elements or units of the image forming apparatus 100A according to the example illustrated in FIGS. 14 through 17, except that the image forming apparatus 100A according to the example illustrated in FIG. 18 has a different direction to discharge air of the air exhaust port 93 from the image forming apparatus 100A according to this example. Therefore, the elements or components of the image forming apparatus 100A according to FIGS. 14 through 17 may be denoted by the same reference numerals as those of the image forming apparatus 100A according to the example illustrated in FIGS. 9 through 13 and the example illustrated in FIGS. 14 through 17 and the descriptions and effects thereof are omitted or summarized.

In this example, the air cooling duct 91 of the fixing part cooling device 90 projects from the back 100*b* of the image forming apparatus 100 to the same position as the projection 165 of the sheet cooling device 70. The air cooling duct 91 has a projecting part that projects from the back 100*b* of the image forming apparatus 100. The projecting part of the air cooling duct 91 has a shape bending at a right angle toward an opposite side with respect to the sheet discharging side and the air exhaust port 93 extends in a direction perpendicular to the back 100*b* of the image forming apparatus 100.

According to this configuration, when the warm air exhausted from the air exhaust port 93 after cooling the fixing device 33 is drawn to the first air intake port 62*a*, an amount of the warm air drawn to the first air intake port 62*a* can be reduced more than the amount of air in the example illustrated in FIGS. 14 through 17. As a result, the size of the region A illustrated in FIG. 17 can be reduced.

Figure 19:
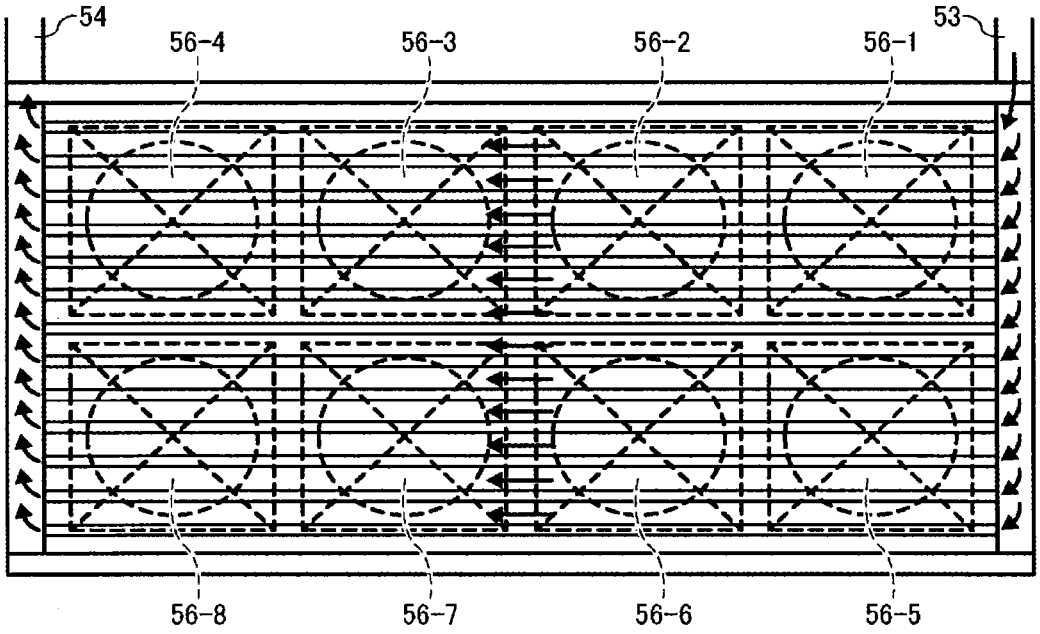
FIG. 19 is a diagram illustrating a configuration of a radiator included in a sheet cooling device of an image forming apparatus according to another example.
Figure 20:
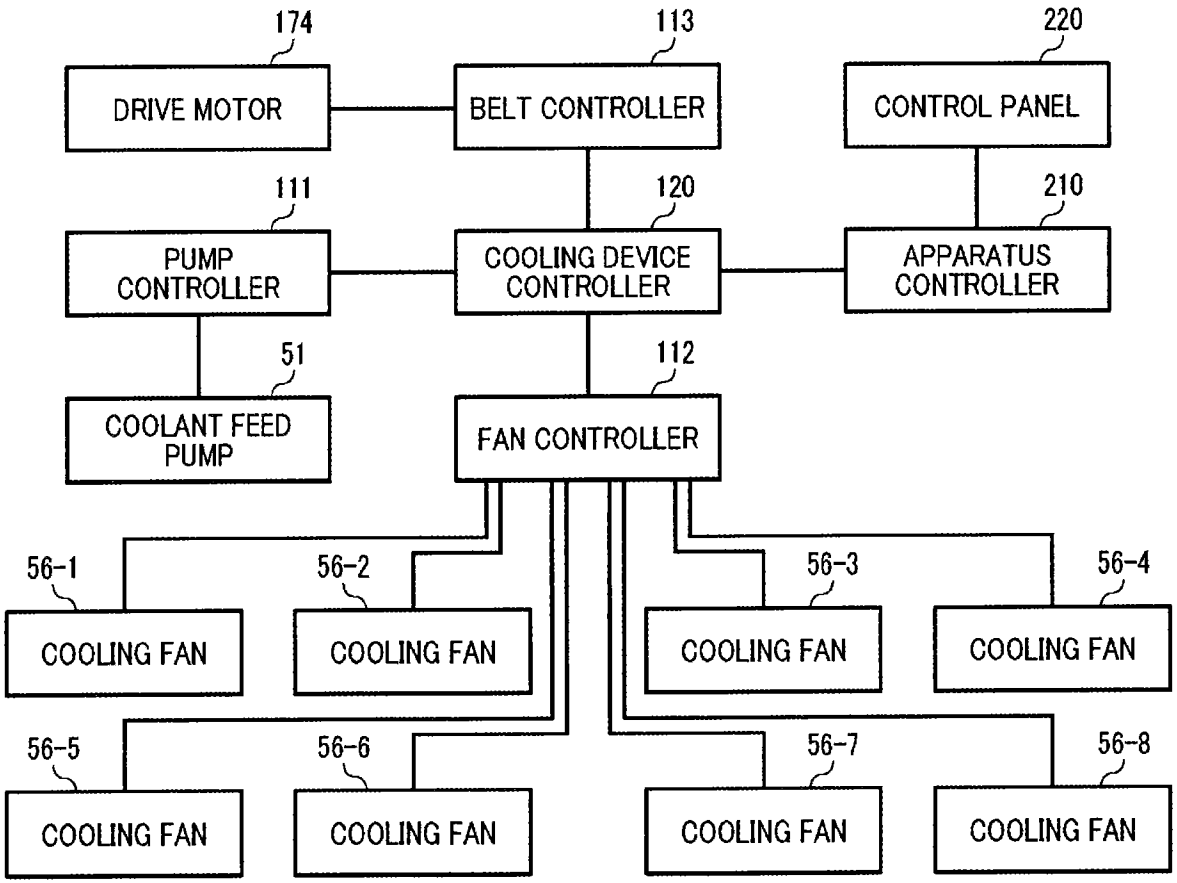
FIG. 20 is a block diagram illustrating a controller according to the example of FIG. 19.

Next, a description is given of a different configuration of the image forming apparatus 100A according an example of this disclosure with reference to FIGS. 19 and 20.

FIG. 19 is a diagram illustrating a configuration of the radiator 52 included in the sheet cooling device 70 of the image forming apparatus 100A according to this example. FIG. 20 is a block diagram illustrating an apparatus controller 210 and other controllers and units connected to the apparatus controller 210 according to this example.

The elements or units of the image forming apparatus 100A according to this example illustrated in FIG. 19 are similar in structure and functions to the elements or units of the image forming apparatus 100A according to the example illustrated in FIGS. 14 through 17, except that the image forming apparatus 100A according to the example illustrated in FIG. 19 has a different configuration in the vicinity of the radiator 52. However, this configuration of the radiator 52 of this example can be applied to the configuration of the radiator 52 of the example illustrated in FIGS. 1 through 6, the example illustrated in FIGS. 7 and 8, and the example illustrated in FIGS. 9 through 13.

As illustrated in FIG. 19, the radiator 52 according to this example includes multiple cooling fans 56. More specifically, the cooling fan 56 includes eight cooling fans 56-1 through 56-8, four of which are disposed at an upper side of the radiator 52 along the coolant flowing direction (i.e., cooling fans 56-1 through 56-4) and the other four of which are disposed at a lower side of the radiator 52 along the coolant flowing direction (i.e., cooling fans 56-5 through 56-8). In other words, two sets of four cooling fans 56 are aligned in the coolant inlet direction (the vertical direction) at the entrance of the coolant.

The block diagram illustrated in FIG. 20 includes a drive motor 174, a belt controller 113, a control panel 220, a pump controller 111, a cooling device controller 120, the apparatus controller 210, the coolant feed pump 51, a fan controller 112, and the cooling fans 56-1 through 56-8.

As illustrated in FIG. 20, the cooling fans 56-1 through 56-8 are controlled by a fan controller 112. Here, the cooling device controller 120 is provided in the image forming apparatus 100A of the present example. The fan controller 112 is connected to the cooling device controller 120. The cooling device controller 120 communicates with an apparatus controller 210 that is also provided in the image forming apparatus 100A to share information input from a control panel 220 related to types of the sheet P.

Further, the cooling device controller 120 is connected to a belt controller 113 and a pump controller 111. The belt controller 113 controls the drive motor 174 to rotate the upper conveying belt 83 of the upper belt unit 82 of the belt conveying unit 81 and the lower conveying belt 86 of the lower belt unit 85 of the belt conveying unit 81. The pump controller 111 controls the coolant feed pump 51 of the sheet cooling device 70.

The cooling device controller 120 includes a CPU (central processing unit), a RAM (random access memory), a ROM (read only memory), and so forth. Information of drive members obtained by tests based on respective conditions is stored in the RAM and calculated based on a program stored in the ROM, so that driving of each of the drive members is controlled via a corresponding controller.

Here, in the present example, the cooling performance of the sheet cooling device 70 is changed based on information input by a user who is an operator via the control panel 220 that functions as an operation panel according to the type of the sheet P. For example, when setting respective sheets P in the two sheet trays 30 provided to the image forming apparatus 100A, the user operates the control panel 220 to input the type of the sheet P set in the respective sheet trays 30. The information related to the types of the respective sheets P inputted via the control panel 220 is associated with the corresponding sheet tray 30 and stored in a non-volatile memory. When forming an image, the apparatus controller 210 reads information related to the types of the respective sheets P set in the sheet trays 30 based on designated information of the corresponding sheet tray 30 and sends the appropriate information to the cooling device controller 120. The cooling device controller 120 controls the cooling fans 56-1 through 56-8 via the fan controller 112 based on the information related to the sheet P inputted from the apparatus controller 210. By so doing, the sheet P can be cooled with the cooling performance of the cooling device according to the type of the sheet P used for image formation. Accordingly, the sheet P used for image formation can be cooled efficiently.

Specifically, by changing the number of rotation of the entire cooling fans 56-1 through 56-8 and/or by controlling ON/OFF of rotation of part of the cooling fan 56, the cooling performance of the cooling device can be changed. For example, when handling a sheet that is relatively difficult to be cooled, the whole cooling fans 56-1 through 56-8 are rotated at the maximum number of rotations or all the cooling fans 56-1 through 56-8 are turned on. By contrast, when handling a sheet that is relatively easy to be cooled, the whole cooling fans 56-1 through 56-8 are rotated at a reduced number of rotations or all the cooling fans 56-1 through 56-8 are turned off.

It is preferable that the cooling fan to be rotated at a reduced number of rotations or be turned off is disposed facing a region of the radiator 52 through which the cooling air at high temperature passes. Specifically, the cooling fan 56-1 or the cooling fan 56-5 disposed in the vicinity of the coolant inlet port 53 is rotated at a reduced number of rotations or is turned off. By reducing the number of rotations or by turning off the cooling fan 56-1 or the cooling fan 56-5, an amount of outside air taken in through the first air intake port 62*a* on the side of the air exhaust port 93 can be decreased. As a result, taking in part of the air at high temperature from the first air intake port 62*a* after cooling the fixing device 33 can be prevented.

Figure 21:
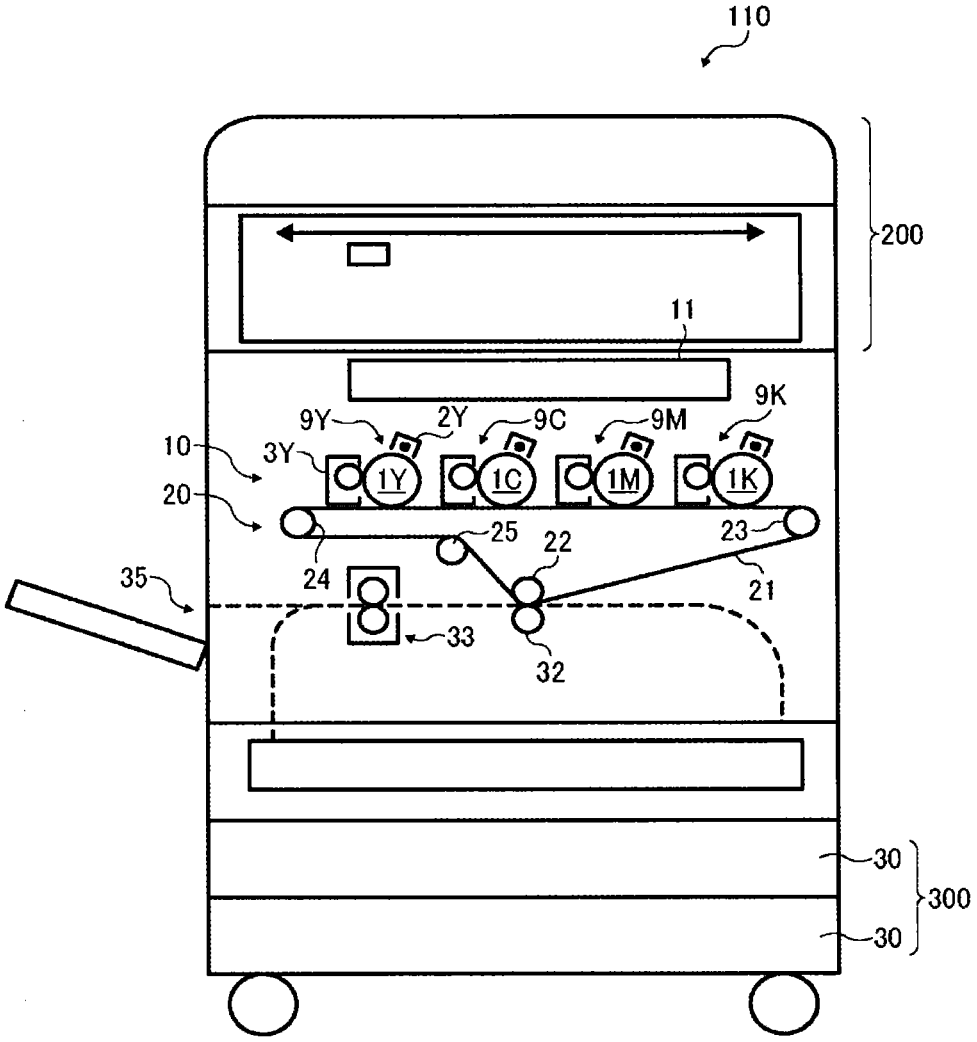
FIG. 21 is a diagram illustrating an example of an image forming apparatus to which the cooling devices according to the above-described examples are applied.

In the above-described examples, the disclosure is applied to the image forming apparatuses 100 and 100A, each of which is a printer and can function as a multifunctional image forming apparatus including functions of a copier and a facsimile machine by embedding optional substrate having functions of a scanner and a facsimile machine into the apparatus body 150. However, the disclosure is not limited thereto. For example, as illustrated in FIG. 21, the disclosure can be applied to a copier 110 that originally includes a scanner 200 and a sheet feeder 300 having two separable sheet trays 30.

Further, in the above-described examples, the disclosure is applied to the developer cooling device 50 and the sheet cooling device 70. However, the disclosure is not limited thereto. For example, the optical writing device 11 provided to the image forming apparatus of FIG. 1 and the image forming apparatus 100A of FIG. 9 includes a laser light source and a polygon mirror that rotates at high speed, which are driven by respective motors. This disclosure can be applied to a liquid cooling device or devices to cool these motors. Specifically, this disclosure can be applied to any units and members (parts) that can raise the temperature of the image forming apparatus.

Further, the image forming apparatuses 100 and 100A include the fixing part cooling device 90 that cools the air as the cooling target that flows around the fixing device 33, besides the developer cooling device 50 and the sheet cooling device 70, both of which function as a liquid cooling device. However, this disclosure is not limited to this configuration but can be applied to an image forming apparatus in which multiple cooling devices are provided to cool multiple cooling targets.

Further, the image forming apparatuses 100 and 100A include the air intake port 62 as a single air inlet port and the air exhaust port 63 as a single air outlet port in the liquid cooling duct 61 provided to the heat releasing part 60 of the developer cooling device 50 and the sheet cooling device 70. However, this disclosure is not limited to this configuration but can be applied to an image forming apparatus in which at least either one of the air intake port 62 and the air exhaust port 63 includes multiple ports when a large amount of heat of the cooling device is required to cool the cooling target.

In these cases, the cooling air at high temperature flows at the upstream side of the radiator in the coolant flowing direction of the coolant that flows in the vicinity of the coolant inlet port or in the coolant conduits according to the temperature of the cooling air that passes through the air flowing paths of the radiator that functions as a heat releasing unit.

Further, the image forming apparatuses 100 and 100A include the liquid cooling duct 61 that functions as an air flowing space having the air intake port 62 and the air exhaust port 63 provided to the heat releasing part 60 of the developer cooling device 50 and the sheet cooling device 70. However, this disclosure is not limited to this configuration. For example, this disclosure can be applied to an image forming apparatus in which a different unit such as an inspection panel that is disposed as an exterior unit of the image forming apparatus is included as the part or entire of the air flowing space, an air intake port and an air exhaust port are provided to the air flowing space, and the heat releasing unit and the cooling fan are also provided to the image forming apparatus.

Further, the liquid cooling device of the image forming apparatuses 100 and 100A, such as the developer cooling device 50 of the image forming apparatus 100 and the sheet cooling device 70 of the image forming apparatus 100A, cools one type of a cooling target. However, this disclosure is not limited to this configuration. For example, this disclosure can be applied to a liquid cooling device that can cool various types of cooling targets, which are various types of adjacent devices, units, and members to be cooled.

Further, the image forming apparatuses 100 and 100A include the fixing part cooling device 90 that functions as a cooling device in which air having a temperature raised by cooling the fixing device 33 is exhausted from the air exhaust port 93 and is taken in through the air intake port 62. However, this disclosure is not limited to this configuration. For example, this disclosure can be applied to a liquid sheet cooling device in which the air having the raised temperature exhausted from an air exhaust port is taken in by an air intake port of a liquid developer cooling device.

Further, the disclosure has been described to apply to the tandem-type image forming apparatuses 100 and 100A (and 110) having an intermediate transfer method. However, this disclosure is not limited to this configuration but can be applied to any one of a tandem-type image forming apparatus having a direct transfer method, an image forming apparatus having a single image forming part (e.g., a single photoconductor), and an image forming apparatus having a revolver and an intermediate transfer method.

The above-described embodiments are illustrative and do not limit this disclosure. Thus, numerous additional modifications and variations are possible in light of the above teachings. For example, elements of at least one of features of different illustrative and exemplary embodiments herein may be combined with each other, and/or substituted for each other within the scope of this disclosure and appended claims. Further, features of components of the embodiments, such as the number, the position, and the shape are not limited by the embodiments and thus may be preferably set. It is therefore to be understood that within the scope of the appended claims, the disclosure of this disclosure may be practiced otherwise than as specifically described herein.

What is claimed is:

1. A liquid cooling device comprising:

a heat receiving part of an image forming apparatus comprising a heat receiving unit to transport heat received from a cooling target to a coolant; and a heat releasing part of the image forming apparatus comprising:

a heat releasing unit including a coolant flowing path into which the coolant with the heat transported at the heat receiving part flows and an air flowing path in which air passes and conducts heat exchange with the coolant;

a cooling fan to generate air flow that passes through the air flowing path; and an air flowing space including an air inlet port from which the air that passes through the air flowing path is taken in and an air outlet port from which the air that has passed through the air flowing path is exhausted, wherein, the air flowing path includes an upstream region and a downstream region along a coolant flowing direction of the coolant flowing path of the heat releasing part, air at a first temperature flows into the upstream region of the air flowing path, and the air at the first temperature includes at least a part of heated air outside of the image forming apparatus that is exhausted from a heated air outlet port provided in the image forming apparatus and that is taken in through the air inlet port.

2. The liquid cooling device according to claim 1, wherein the coolant flowing path includes multiple coolant flowing paths, wherein, when passing in the air flowing space of the heat releasing part, the air at the first temperature passes in respective upstream regions of the coolant flowing paths more than respective downstream regions of the coolant flowing paths.

3. The liquid cooling device according to claim 1, wherein the heat releasing unit further includes a coolant inlet port into which the coolant flows, a coolant outlet port from which the coolant flows, a coolant divider connected to the coolant inlet port to divide the coolant from the coolant inlet port, and a coolant merger connected to the coolant outlet port to merge the coolant before conveying the coolant to the coolant outlet port, wherein the coolant flowing path includes multiple coolant flowing paths, wherein an upstream end of each of the multiple coolant flowing paths in the coolant flowing direction is connected to the coolant inlet port via the coolant divider and a downstream end of each of the multiple coolant flowing paths in the coolant flowing direction is connected to the coolant outlet port via the coolant merger, wherein the air at the first temperature passes through the air flowing path in a vicinity of the coolant inlet port and the upstream end of the multiple coolant flowing paths.

4. The liquid cooling device according to claim 1, wherein the heat releasing part includes multiple heat releasing units including respective coolant flowing paths and respective air flowing paths, wherein the multiple heat releasing units are connected so that the respective coolant flowing paths thereof are arranged in series, wherein, the respective air flowing paths include an upstream region and a downstream region along the coolant flowing direction of the respective coolant flowing paths of the heat releasing part, and the air at the first temperature flows into the upstream region of the respective air flowing paths.

5. The liquid cooling device according to claim 1, wherein the air inlet port is disposed in a vicinity of the a heated air outlet port provided in the image forming apparatus to exhaust air heated by a heat emitting device disposed in the image forming apparatus to the outside of the image forming apparatus.

6. The liquid cooling device according to claim 5, wherein the air heated by the heat emitting device and taken in from the air inlet port in the vicinity of the heated air outlet port flows into the upstream region of the air flowing path.

7. The liquid cooling device according to claim 1, wherein the air inlet port comprises a back air inlet port and a side air inlet port located farther than the back air inlet port with respect to the heated air outlet port provided in the image forming apparatus to exhaust air heated by a heat emitting device disposed in the image forming apparatus, wherein the heat releasing unit further includes a coolant inlet port into which the coolant flows and a coolant outlet port from which the coolant flows, wherein the air taken in from the side air inlet port flows to the air flowing path in a vicinity of the coolant outlet port.

8. An image forming apparatus comprising:

an image forming device that forms an image on a recording medium; and the liquid cooling device according to claim 1 that cools the recording medium.

9. The image forming apparatus according to claim 8, further comprising a controller, wherein the cooling fan includes multiple cooling fans aligned in a direction in the coolant flowing direction in the heat releasing unit, wherein the controller controls output of the multiple cooling fans and adjusts cooling performance of the liquid cooling device, wherein, when lowering the cooling performance of the liquid cooling device, the controller either reduces or turns off at least one cooling fan, which is one of the multiple cooling fans and is disposed in a vicinity of a coolant inlet port.

10. A liquid cooling device comprising:

a heat receiving part of an image forming apparatus comprising a heat receiving unit to transport heat received from a cooling target to a coolant; and a heat releasing part of the image forming apparatus comprising:

a heat releasing unit including a coolant inlet port into which the coolant with the heat transported at the heat receiving part flows, a coolant outlet port from which the coolant flows, and an air flowing path through which air passes and conducts heat exchange with the coolant;

a cooling fan to generate air flow that passes through the air flowing path; and an air flowing space including an air inlet port through which the air that passes through the air flowing path is taken in and an air outlet port through which the air that has passed through the air flowing path is exhausted, wherein air at a first temperature flows in the air flowing path in a vicinity of the coolant inlet port according to a temperature distribution that varies across a direction perpendicular to an air flowing direction of the air that passes through the air flowing path, and the air at the first temperature includes at least a part of heated air outside of the image forming apparatus that is exhausted from a heated air outlet port provided in the image forming apparatus and that is taken in through the air inlet port.

11. The liquid cooling device according to claim 10, wherein the heat releasing unit includes a coolant flowing path where the coolant flows from the coolant inlet port to the coolant outlet port, so that the coolant flows from an air flowing region at the first air temperature to an air flowing region at a second air temperature that is lower than the first air temperature.

12. The liquid cooling device according to claim 10, wherein the air inlet port is disposed in a vicinity of the heated air outlet port provided in the image forming apparatus to exhaust air heated by a heat emitting device disposed in the image forming apparatus to the outside of the image forming apparatus.

13. The liquid cooling device according to claim 12, wherein the air heated by the heat emitting device and taken in from the air inlet port in the vicinity of the heated air outlet port flows into the air flowing path in the vicinity of the coolant inlet port.

14. An image forming apparatus comprising:

an image forming device that forms an image on a recording medium; and the liquid cooling device according to claim 10 that cools the recording medium.

15. An image forming apparatus comprising:

a liquid cooling device comprising:

a heat receiving part including a heat receiving unit to transport heat received from a cooling target to a coolant; and a heat releasing part including a heat releasing unit including a coolant flowing path into which the coolant with the heat transported at the heat receiving part flows and an air flowing path through which air passes and conducts heat exchange with the coolant;

a cooling fan to generate air flow that passes through the air flowing path; and an air flowing space including an air inlet port through which the air that passes through the air flowing path is taken in and an air outlet port through which the air that has passed through the air flowing path is exhausted;

a heat emitting device to emit heat when fixing an image to a recording medium to be cooled by the liquid cooling device; and a heated air outlet port disposed in the air flowing space at one side in a width direction of the recording medium to exhaust air heated by the heat emitting device to an outside of the image forming apparatus, and at least a part of the heated air outside of the image forming apparatus that is exhausted from the heated air outlet port is taken in through the air inlet port, wherein the heated air outlet port is located at an upstream side of the coolant flowing path in the coolant flowing direction.

16. The image forming apparatus according to claim 15, wherein the air inlet port and the heated air outlet port face a same direction.

17. The image forming apparatus according to claim 15, wherein the air inlet port faces a direction that intersects a direction in which the heated air outlet port faces.

18. The image forming apparatus according to claim 15, wherein the air inlet port comprises a back air inlet port and a side air inlet port, and the side air inlet port is located farther away from a heated air outlet port than the back air inlet port is located from the heated air outlet port, wherein the side air inlet port and the heated air outlet port are located at opposite sides with respect to the back air inlet port.

* * * * *